US008103029B2

(12) United States Patent
Ngia et al.

(10) Patent No.: US 8,103,029 B2
(45) Date of Patent: Jan. 24, 2012

(54) EARSET ASSEMBLY USING ACOUSTIC WAVEGUIDE

(75) Inventors: Lester S. H. Ngia, Troy, MI (US); Christopher F. Vlach, Northfield Center, OH (US); Tarun Pruthi, Beachwood, OH (US)

(73) Assignee: Think-A-Move, Ltd., Beachwood, OH (US)

( * ) Notice: Subject to any disclaimer, the term of this patent is extended or adjusted under 35 U.S.C. 154(b) by 555 days.

(21) Appl. No.: 12/272,131

(22) Filed: Nov. 17, 2008

(65) Prior Publication Data

US 2009/0209304 A1 Aug. 20, 2009

Related U.S. Application Data

(60) Provisional application No. 61/030,113, filed on Feb. 20, 2008.

(51) Int. Cl.
*H04R 25/00* (2006.01)

(52) U.S. Cl. ..... 381/312; 704/246; 704/E15.001

(58) Field of Classification Search ..... 381/312; 704/246, E15.001

See application file for complete search history.

(56) References Cited

U.S. PATENT DOCUMENTS

| | | | |
|---|---|---|---|
| 3,995,113 | A | 11/1976 | Tani |
| 4,017,797 | A | 4/1977 | Laessig |
| 4,025,734 | A | 5/1977 | Aloupis |
| 4,150,262 | A | 4/1979 | Ono |
| 4,429,702 | A | 2/1984 | von Recklinghausen |
| 4,628,528 | A | 12/1986 | Bose et al. |
| 4,652,702 | A | 3/1987 | Yoshii |

(Continued)

FOREIGN PATENT DOCUMENTS

| | | |
|---|---|---|
| CH | 678692 | 10/1991 |

(Continued)

OTHER PUBLICATIONS

Sound Radio Products™ Better Living Through Wireless Technology, printed from the internet at http://www.soundradio.com/en-921.html, Oct. 29, 2001.

(Continued)

*Primary Examiner* — Creighton Smith
(74) *Attorney, Agent, or Firm* — Renner, Otto, Boisselle & Sklar, LLP

(57) ABSTRACT

An earset assembly including a first earpiece, a second earpiece, and an electrical circuit. The first earpiece includes an internal microphone to capture speech of a user and an internal speaker, and is positionable with respect to a first ear of the user so that the internal microphone detects the speech from the first ear of the user. The second earpiece includes an internal speaker, and is positionable with respect to a second ear of the user. The electrical circuit operatively connects the internal microphone and the internal speakers to a communication device. In an audio listening state, the electrical circuit is configured to operatively couple the internal speakers respectively to first and second audio ports of the communication device for outputting stereo audio content with the speakers, and the internal microphone is switched to an off state. In a communication state, the electrical circuit is configured to switch the internal speaker of the first earpiece to an off state, switch the internal microphone of the first earpiece to an on state for voice communication and operatively couple the internal microphone to a microphone port of the communication device, and maintain the operative coupling of the internal speaker of the second earpiece to the respective audio port for use in the voice communication.

20 Claims, 9 Drawing Sheets

U.S. PATENT DOCUMENTS

| | | | | |
|---|---|---|---|---|
| 4,930,156 | A | 5/1990 | Norris | |
| 4,972,491 | A | 11/1990 | Wilcox, Jr. | |
| 5,164,984 | A | 11/1992 | Suhami et al. | |
| 5,251,263 | A | 10/1993 | Andrea et al. | |
| 5,280,524 | A | 1/1994 | Norris | |
| 5,298,692 | A | 3/1994 | Ikeda et al. | |
| 5,327,506 | A | 7/1994 | Stites, III | |
| 5,363,444 | A | 11/1994 | Norris | |
| 5,373,555 | A | 12/1994 | Norris et al. | |
| 5,426,719 | A | 6/1995 | Franks et al. | |
| 5,448,637 | A | 9/1995 | Yamaguchi et al. | |
| 5,604,812 | A | 2/1997 | Meyer | |
| 5,606,607 | A | 2/1997 | Yamaguchi et al. | |
| 5,657,384 | A * | 8/1997 | Staudacher et al. | 379/406.08 |
| 5,659,156 | A | 8/1997 | Mauney et al. | |
| 5,659,620 | A | 8/1997 | Kuhlman | |
| 5,664,014 | A | 9/1997 | Yamaguchi et al. | |
| 5,790,684 | A | 8/1998 | Niino et al. | |
| 5,812,659 | A | 9/1998 | Mauney et al. | |
| 5,832,094 | A | 11/1998 | Le Her | |
| 5,844,984 | A | 12/1998 | Yamaguchi et al. | |
| 5,881,159 | A | 3/1999 | Aceti et al. | |
| 5,896,451 | A | 4/1999 | Deas | |
| 5,933,506 | A | 8/1999 | Aoki et al. | |
| 6,004,274 | A | 12/1999 | Nolan et al. | |
| 6,021,207 | A | 2/2000 | Puthuff et al. | |
| 6,022,311 | A | 2/2000 | Juneau et al. | |
| 6,024,700 | A | 2/2000 | Nemirovski et al. | |
| 6,094,492 | A | 7/2000 | Boesen | |
| 6,175,633 | B1 | 1/2001 | Morrill et al. | |
| 6,181,801 | B1 | 1/2001 | Puthuff et al. | |
| 6,283,915 | B1 | 9/2001 | Aceti et al. | |
| 6,408,081 | B1 | 6/2002 | Boesen | |
| 6,503,197 | B1 | 1/2003 | Nemirovski | |
| 6,560,468 | B1 | 5/2003 | Boesen | |
| 6,567,524 | B1 | 5/2003 | Svean et al. | |
| 6,574,345 | B1 | 6/2003 | Huang | |
| 6,647,368 | B2 | 11/2003 | Nemirovski | |
| 6,661,901 | B1 | 12/2003 | Svean et al. | |
| 6,671,379 | B2 | 12/2003 | Nemirovski | |
| 6,683,965 | B1 | 1/2004 | Sapiejewski | |
| 6,718,043 | B1 | 4/2004 | Boesen | |
| 6,728,385 | B2 | 4/2004 | Kvaloy et al. | |
| 6,741,718 | B1 | 5/2004 | Brumitt et al. | |
| 6,754,358 | B1 | 6/2004 | Boesen et al. | |
| 6,754,359 | B1 | 6/2004 | Svean et al. | |
| 6,952,483 | B2 | 10/2005 | Boesen et al. | |
| 7,039,195 | B1 | 5/2006 | Svean et al. | |
| 7,079,662 | B2 | 7/2006 | Niederdrank | |
| 7,197,152 | B2 * | 3/2007 | Miller et al. | 381/326 |
| 7,574,917 | B2 | 8/2009 | Von Dach et al. | |
| 7,804,975 | B2 | 9/2010 | Meier et al. | |
| 2002/0118852 | A1 | 8/2002 | Boesen | |
| 2002/0143242 | A1 | 10/2002 | Nemirovski | |
| 2002/0186858 | A1 | 12/2002 | Masuda et al. | |
| 2003/0147544 | A1 | 8/2003 | Lichtblau | |
| 2003/0185403 | A1 | 10/2003 | Sibbald | |
| 2004/0125979 | A1 | 7/2004 | Elidan et al. | |
| 2005/0013456 | A1 | 1/2005 | Chaluper et al. | |
| 2005/0058313 | A1 | 3/2005 | Victorian et al. | |
| 2005/0147266 | A1 | 7/2005 | Eggers et al. | |
| 2005/0157895 | A1 | 7/2005 | Lichtblau | |
| 2007/0121974 | A1 | 5/2007 | Nemirovski | |
| 2007/0291953 | A1 | 12/2007 | Ngia et al. | |
| 2008/0253583 | A1 * | 10/2008 | Goldstein et al. | 381/92 |
| 2009/0080670 | A1 | 3/2009 | Solbeck et al. | |
| 2009/0087003 | A1 * | 4/2009 | Zurek et al. | 381/312 |

FOREIGN PATENT DOCUMENTS

| | | |
|---|---|---|
| GB | 2197158 | 5/1988 |
| JP | 10-023578 | 1/1998 |
| SE | 526085 | 6/2005 |
| WO | 94/10818 | 5/1994 |
| WO | 97/09927 | 3/1997 |
| WO | 00/03639 | 1/2000 |
| WO | 00/69215 | 11/2000 |
| WO | 01/39662 | 6/2001 |

OTHER PUBLICATIONS

"Detection of Sensorineural Hearing Impairment by Using DPOAE Technique and Classifiers", A. Nevcihan et al., 1995 IEEE-EMBC and CMBEC, Theme 4: Signal Processing, 0-7803-2475-7/97.

Westerlund et al., "In-ear Microphone Equalization Exploiting an Active Noise Control", Proceedings of Internoise 2001, Aug. 2001, pp. 1-6.

Ngia, Lester S.H., "Separable Nonlinear Least-Squares Methods for Efficient Off-Line and On-line Modeling of Systems Using Kautz and Laguerre Filters", IEEE Transactions on Circuits and Systems—II: Analog and Digital Signal Processing, vol. 48, No. 6, pp. 562-579, Jun. 2001.

Rupp, Markus, "A Family of Adaptive Filter Algorithms with Decorrelating Properties", IEEE Transactions of Signal Processing, vol. 46, No. 3, pp. 771-775, Mar. 1998.

Yasukawa et al., "An Acoustic Echo Canceller Using Subband Sampling and Decorrelation Methods", IEEE Transactions on Signal Processing, vol. 41, No. 2, pp. 926-930, Feb. 1993.

Sjoberg et al., "Nonlinear Modeling, Advanced Black-Box Techniques", Chapter 1, "Neural Nets and Related Model Structures for Nonlinear System Identification", pp. 1-28, Kluwer Academic Publishers, 1998.

Stevens, Kenneth (2000). Acoustic Phonetics (Current Studies in Linguistics). The MIT Press, ISBN 0-262-69250-3.

* cited by examiner

EARSET ASSEMBLY USING ACOUSTIC WAVEGUIDE

RELATED APPLICATION DATA

This application claims the benefit of U.S. Provisional Patent Application No. 61/030,113 filed Feb. 20, 2008, which is incorporated herein by reference in its entirety.

TECHNICAL FIELD

The present disclosure generally relates to an earset assembly having a microphone and/or a speaker that can be placed with respect to an ear.

BACKGROUND

Communication devices (e.g., mobile telephones) have become exceedingly versatile in their functionality. In addition to various communication capabilities (e.g., phone calls, text messages), an increasing number of these communication devices allow the user to use the device as an audio playback device. When used as an audio playback device, audio playback may be accomplished by such means as an internal speaker of the communication device. However, in many environments, this playback is undesired due to distractions to others from the volume of the playback. Alternatively, audio playback may be accomplished by using a headset. Conventional audio headsets generally include speakers that can be removably placed with respect to the user's ear and output sounds to the user's ear. They allow the user to listen to audio playback without disrupting others in the surrounding environment.

Similar headsets have become exceedingly popular in various hands free applications. Hands free headsets allow a user to use a device without the use of the user's hands. In addition to the speakers of conventional audio headsets, hands free headsets typically include a microphone disposed on a support member that positions the microphone with respect to a user's mouth. The microphone is used to detect speech and other vocalizations emanating from the mouth of the user. These hands free headsets may be used in conjunction with a communication device, in voice recognition, in speech recognition, and even as part of a control system. Handsfree headsets are available in both hardwired and wireless (e.g., Bluetooth) embodiments, and allow the user to carry out a task without the use of the user's hands. However, the microphones of the hands free headsets depend largely on their position with respect to the user's mouth and are susceptible to detecting unwanted ambient sound.

SUMMARY OF THE INVENTION

According to an aspect of the disclosure, an earset assembly includes a first earpiece having an internal microphone to capture speech of a user and an internal speaker, the first earpiece positionable with respect to a first ear of the user so that the internal microphone detects the speech from the first ear of the user; a second earpiece having an internal speaker, the second earpiece positionable with respect to a second ear of the user; and an electrical circuit operatively connecting the internal microphone and the internal speakers to a communication device, wherein: in an audio listening state, the circuit is configured to operatively couple the internal speakers respectively to first and second audio ports of the communication device for outputting stereo audio content with the speakers, and the internal microphone is switched to an off state; and in a communication state, the circuit is configured to switch the internal speaker of the first earpiece to an off state, switch the internal microphone of the first earpiece to an on state for voice communication and operatively couple the internal microphone to a microphone port of the communication device, and maintain the operative coupling of the internal speaker of the second earpiece to the respective audio port for use in the voice communication.

In accordance with another aspect, the earset assembly includes a frequency equalizer to apply frequency equalization to the speech captured by the internal microphone.

In accordance with another aspect, the earset assembly includes a frequency equalization switch that switches the coupling of the microphone to the microphone port between bypassing the frequency equalizer and coupling the internal microphone to the communication device through the frequency equalizer to perform the frequency equalization on the captured speech of the user.

In accordance with another aspect, the earset assembly includes a hook condition switch to provide an on-hook condition or an off-hook condition of the communication device.

According to another aspect, the hook condition switch may create a resistance short between the microphone port and a ground port of the communication device to establish the off-hook condition.

In accordance with another aspect, the earset assembly includes an audio state switch that selectively switches between the operative coupling of the internal speaker of the first earpiece for the audio listening state, and the operative coupling of the internal microphone for the communication state.

In yet another aspect of the earset assembly, at least one of the first or second earpieces includes an external microphone to generate an audio signal representation of ambient sound.

In accordance with still another aspect, the representation of the ambient sound is output to the user with at least one of the internal speakers.

According to another aspect, the earset assembly includes an external sound control switch that switches between the output of the representation of ambient sound and the output of the stereo audio.

In accordance with another aspect, the earset assembly includes an external microphone amplifier that controls amplitude of the audio signal representation of ambient sound.

In yet another aspect of the earset assembly, the external microphone is a part of the first ear piece.

According to another aspect of the earset assembly, a second external microphone generates an audio signal representation of ambient sound, and is a part of the second earpiece.

In accordance with another aspect of the earset assembly, the audio signal representation of ambient sound of the first external microphone is output to the user with the internal speaker of the first earpiece and the audio signal representation of ambient sound of the second external microphone of the second earpiece is output to the user with the internal speaker of the second earpiece.

In accordance with yet another aspect of the earset assembly, the first earpiece includes an acoustic waveguide between the internal microphone and an ear canal of the user.

According to another aspect of the earset assembly, the earpieces each include an acoustic waveguide between the speaker and the ear canal of the user.

According to another aspect of the disclosure, a method of audio playback and voice communication includes, in an audio listening state, outputting stereo audio content to a user with first and second internal speakers, the first internal speaker being part of a first earpiece positionable with respect to a first ear of the user, the first earpiece also including an internal microphone to capture speech from the first ear, and the second internal speaker being part of a second earpiece positionable with respect to a second ear of the user; and switching from the audio listening state to a communication state in which the speech from the user is captured and the second speaker is used to output sounds for the voice communication, wherein: for the audio listening state, a circuit that interfaces the earpieces with an electronic device is configured to operatively couple the internal speakers respectively to first and second audio ports of the electronic device for outputting the stereo audio content to the internal speakers, and the internal microphone is switched to an off state; and for the communication state, the circuit is configured to switch the internal speaker of the first earpiece to an off state, switch the internal microphone of the first earpiece to an on state for the voice communication and operatively couple the internal microphone to a microphone port of the electronic device, and maintain the operative coupling of the internal speaker of the second earpiece to the respective audio port of the electronic device for use in the voice communication.

In accordance with another aspect, the method of audio playback and voice communication includes frequency equalizing the speech captured by the internal microphone.

In accordance with another aspect, the method of audio playback and voice communication includes detecting ambient sound with at least one external microphone and outputting a representation of the detected ambient sound with at least one of the internal speakers.

DESCRIPTION

I. Introduction

Figure 1:
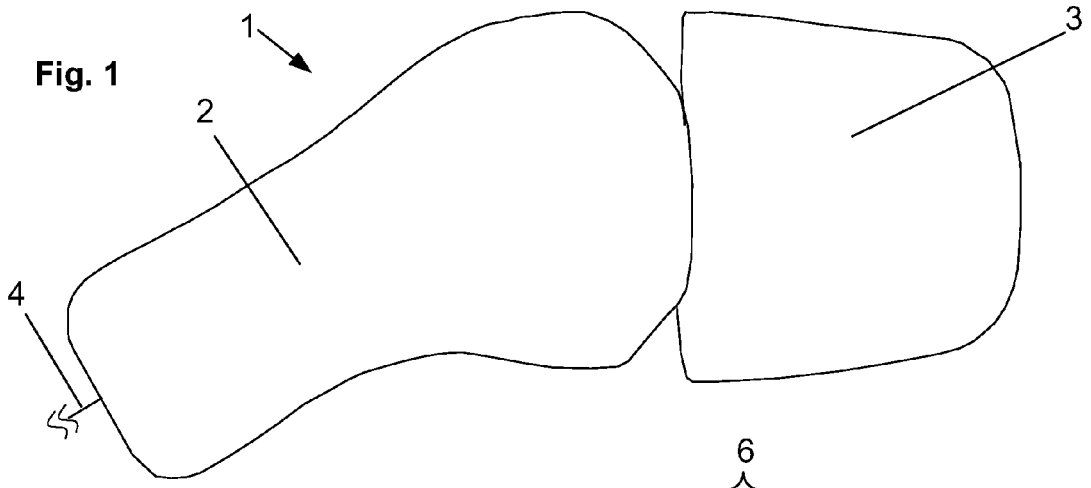
FIG. 1 is an external side view of an exemplary earpiece.

In the description that follows, like components have been given the same reference numerals, regardless of whether they are shown in different embodiments. To illustrate an embodiment(s) of the present invention in a clear and concise manner, the drawings may not necessarily be to scale and certain features may be shown in somewhat schematic form. Features that are described and/or illustrated with respect to one embodiment may be used in the same way or in a similar way in one or more other embodiments and/or in combination with or instead of the features of the other embodiments.

Disclosed is an exemplary earpiece headset design that includes internal speakers positioned with respect to the user's ears, as well as an internal microphone positioned with respect to one of the user's ears that detects acoustic signals from the user's ear, including, for example, speech, grunts, whistles, singing, coughs, clicking sounds made by movement of the lips or tongue, and the like. The earset apparatus allows the user to use the headset in conjunction with both audio playback as well as voice communication in a hands free manner, without the inherent problems of conventional hands free headsets. The apparatus may be used in conjunction with a communication device (e.g. a mobile phone), a voice recognition device, a speech recognition device, and the like. The earset assembly also may be used as part of a control system.

In one embodiment, the earset assembly includes two earpieces, one earpiece including an internal microphone and an internal speaker, and a second earpiece including at least an internal speaker. Each earpiece is retained by one of the ears of the user by inserting the earpiece at least partially into the ear of the user. In one embodiment, sounds are conveyed from an ear canal of the user to the internal microphone of the earset through an air medium via an acoustic waveguide with characteristics specially designed to achieve a desired speech quality. An input portion of the microphone may be in fluid communication with the ear canal. Hence, the earset assembly does not rely on the detection of sound that has emanated directly from the user's mouth. Sounds are also conveyed from the internal speaker(s) of the earset to the ear canals of the user. In one embodiment, sounds from the speaker are conveyed through an air medium via an acoustic waveguide with characteristics specially designed to achieve a desired speech quality.

In another embodiment, the earset assembly includes at least one external microphone located on the earset assembly. The external microphone(s) allows the user to hear ambient sound while the user is using the earset assembly. For purposes of the description, ambient sound (also referred to as ambient noise) includes those sounds generated external to the ear, such as the environment, a person talking, or the like.

The earset assembly may include an electrical circuit that allows switching between an audio listening state and a communication state. In one embodiment, frequency equalization is applied to the acoustic signal detected by the internal microphone. In another embodiment, the electrical circuit allows switching between listening to output from an electronic device and ambient sound detected by one or more external microphones. The switching may be performed by manual use of switches, command inputs or menu selections made by the user, by automatic action as determined by control logic, or a combination of these technologies.

Without intending to be bound by theory, the disclosed earset assemblies allow a user to speak more quietly (e.g., such as at a whisper or near whisper) than is found with conventional headsets. This allows for more private conversations and less disruption to others. Furthermore, because the earset assembly of the present invention does not rely on the detection of sound that has emanated directly from the user's mouth, there is a reduced need to repeatedly adjust the position of the earset that would otherwise distract the user and require the use of the user's hands. The detection of ambient sounds is also significantly reduced by the arrangement of the earpieces with respect to the user's ears. However, in embodiments with an external microphone, the user may listen to ambient sounds with the earset assembly.

II. Earpiece Apparatus

Disclosed are several embodiments of an earset assembly that conveys sounds from an ear canal to an internal microphone of the earset through an air medium via an acoustic pathway. In a similar manner, the earset may include an internal loudspeaker that converts a signal to sound waves, which are emitted to the ear canal through an air medium via an acoustic pathway. The acoustic pathway may behave as an acoustic waveguide. The length, cross-sectional area and material used to make the acoustic pathway that behaves as an acoustic waveguide may affect the spectrum of the captured microphone signal and emitted loudspeaker signals, such as amplifying desired frequencies and/or attenuating other, less desirable, frequencies. The acoustic pathway that behaves as an acoustic waveguide may be made, at least in part, from a tube, a stem, an earpiece tip, or a combination of these components. It will be understood that the ear canal of the user possesses its own acoustic properties. But the ear canal is not a part of the acoustic pathway as described in this document since the acoustic characteristics of the ear canal are difficult to control for achieving a desired speech quality.

Focusing on a tube as an exemplary acoustic waveguide component, the length of the tube may be selected so that signals in a desired frequency range are amplified. The frequency that receives the maximum amplification is called the resonance frequency of the tube. The amplification at the resonance frequency depends on the loss characteristics of the tube, which are related at least in part to the cross-sectional area of the tube and the material used to make the tube. These properties generally may be understood from the theory of acoustics.

After reading this document, it will be appreciated that there are earpiece embodiments that do not include an acoustic waveguide as formed, at least in part, by a tube, a stem, and/or an earpiece tip. For instance, if modification to the frequency spectrum of an internal microphone and/or a loudspeaker is not desired, the internal microphone and/or the loudspeaker may be positioned with respect to the ear canal of a person so that sound is communicated without use of a pathway that behaves as an acoustic waveguide. In this respect, an earpiece may be constructed where sound waves are not conveyed to a microphone and/or from a speaker through an acoustic waveguide.

The use of an acoustic waveguide in connection with the internal microphone may result in improvement of detection performance that may facilitate the use of the earpiece in a number of applications. For instance, the earpiece may be used to generate a signal containing a representation of the user's speech for speech recognition processing, for telecommunications, for command and control processing, and so forth.

Turning now to the figures, FIG. 1 illustrates an external side view of an exemplary earpiece 1. The earpiece 1 includes an earpiece housing 2, earpiece tip 3, and wires 4. This view may be considered representative of the appearance of all of the earpiece embodiments described in this document. The earpiece 1 may be used by inserting the tip 3 at least partially into the ear of a person, such as by placing the tip near the opening of the ear canal or slightly into the ear canal. An opening in the tip (e.g., as best shown in subsequent figures) should preferably be in fluid communication with the ear canal of the user.

The earpiece housing 2 may be constructed from any suitable material, such as plastic, rubber, or the like. In one embodiment, the earpiece housing 2, or portions thereof, is made of relatively rigid plastic, but alternative embodiments may include making the earpiece housing 2 from pliable material, sound absorbing (or sound proofing) material, and/or include sound insulating material such as foam. The earpiece housing 2 may define a hollow cavity in which the operative components of the earpiece 1 are placed.

Various earpiece embodiments will now be described. The earpieces may include similar items and/or similar attributes with respect to their construction. Therefore, for the sake of brevity, a feature described in detail in one embodiment will not be repeated in detail when the feature or a similar feature is present in a subsequently described embodiment.

Figure 2:
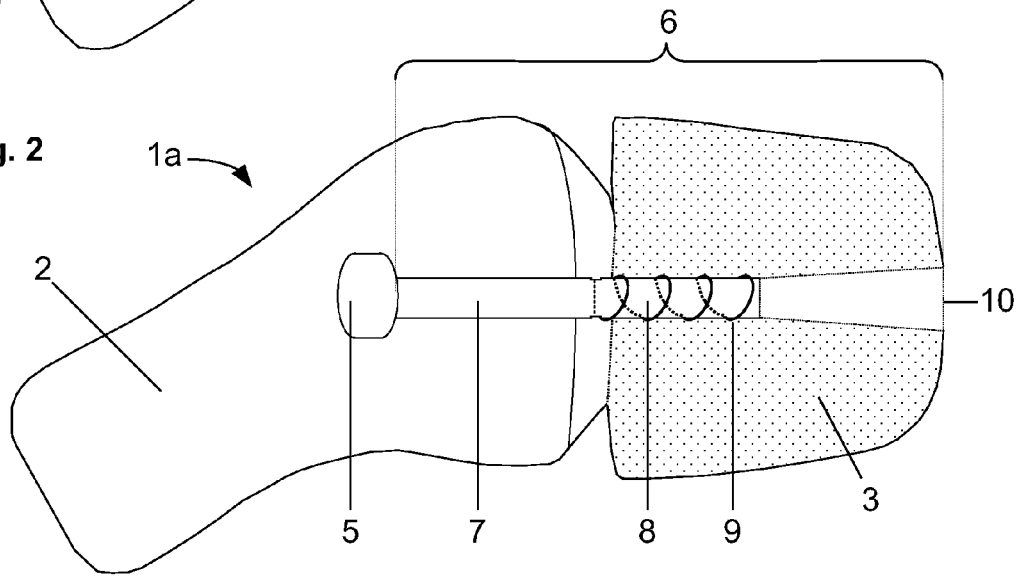
FIG. 2 is a partially broken away side view of an exemplary earpiece containing an internal microphone assembly and acoustic waveguide.

With additional reference to FIG. 2, the earpiece 1 may include an internal microphone assembly 5 that is disposed in and supported by the earpiece housing 2. The physical arrangement and detailed operation of the internal microphone assembly 5 will be described more fully below. In one embodiment, voids in the cavity of the earpiece housing 2 may be unfilled or filled with foam or other material. In another embodiment, the inside surfaces of the earpiece housing 2 may be shaped to conform to the components contained therein so that the volume of any unoccupied cavities surrounding the various components is minimized.

The earpiece housing 2 may take on a number of different physical configurations. For example, the earpiece housing 2 may resemble a miniature earphone as found in conventional telephone headsets or as used with personal audio/music players (e.g., an earbud). Alternatively, the earpiece housing 2 may resemble the housing design of a hearing aid, particularly a digital hearing aid.

One or more wires 4 may extend from the earpiece housing 2, and may couple the operative components of the earpiece 1 to an electronic device. Alternatively, the earpiece 1 may include a wireless transceiver, such as a Bluetooth transceiver, for wirelessly exchanging signals with an electronic device.

The earpiece tip 3 may be constructed from any suitable material, such as a foam, plastic, gel, rubber, or the like. Examples of suitable, commercially available earpiece tips are Comply Canal Tips, available from Hearing Components, 615 Hale Avenue North, Oakdale, Minn. 55128. The earpiece tip 3 is at least partially inserted into the ear of the user, such as by placing the end of the earpiece tip 3 distal to the earpiece housing 2 near the opening of the ear canal or slightly into the ear canal. Some compression of the earpiece tip 3 may occur upon insertion and the tip 3 may conform to the anatomy of the user's ear to fluidly seal the ear canal of the user from the surrounding environment. As will be discussed in greater detail below, in one embodiment, the earpiece tip 3 may be secured to the earpiece housing 2 with a tip adapter insert. In alternative embodiments, the earpiece tip 3 may be secured to the earpiece housing 2 with adhesive or other bonding means. The earpiece tip 3 may be placed relative to the ear of the user so that an opening 10 of a channel in the earpiece tip 3 is in fluid communication with the ear canal of the user. In this manner, sounds from the ear canal may enter the earpiece 1. Friction between the earpiece tip 3 and the ear may hold the earpiece 1 in place with respect to the ear of the user, or there may be an additional structure attached to the earpiece housing 2 to assist in holding the earpiece 1 in place.

With continued reference to FIG. 2, an exemplary earpiece 1*a* that includes an internal microphone assembly 5 and a tube 7 is illustrated. The end of the earpiece tip 3 distal to the earpiece housing 2 includes the earpiece tip opening 10. In one embodiment, the earpiece tip 3 is annual to form a channel or passageway that allows acoustic signals to pass from the ear canal of the user to an internal microphone. In alternative embodiments, the earpiece tip opening 10 may be any other suitable cross-sectional shape.

The internal microphone assembly 5 is disposed in the earpiece housing 2. The internal microphone assembly 5 is used to capture acoustic signals from an ear canal of the user. A description of tongue and other vocal and non-vocal commands that may be captured from an ear of the user may be found in U.S. Pat. No. 6,503,197, which is incorporated herein by reference in its entirety.

Figure 3:
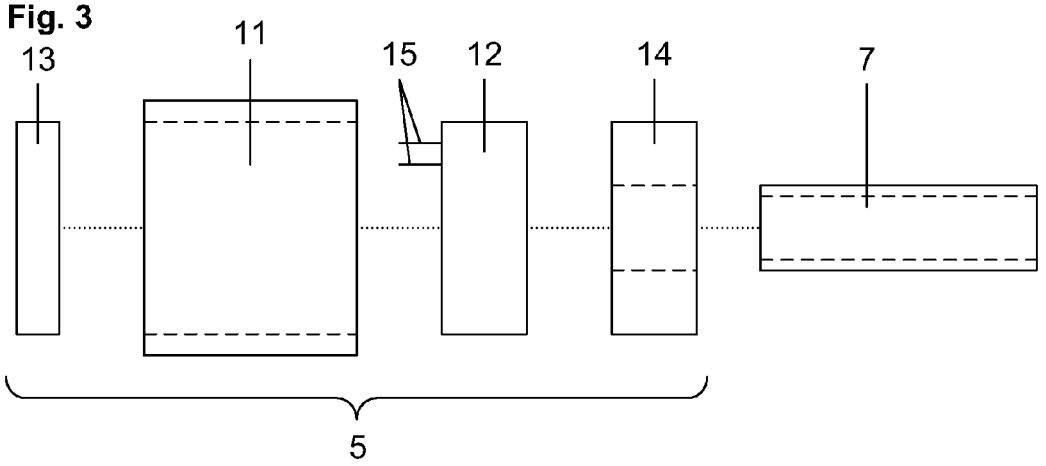
FIG. 3 is an exploded view of an internal microphone assembly.

With additional reference to FIG. 3, an exploded view of the microphone assembly 5 and tube 7 is shown. The internal microphone assembly 5 may include a microphone housing 11, an internal microphone 12, potting material 13, and a fiber washer 14. The microphone housing 11 may be constructed from any suitable material, such as polypropylene or the like. In one embodiment, the microphone housing 11 is cylindrical in shape, having an internal diameter that is slightly smaller than the outer diameter of the internal microphone 12. In one embodiment, the internal length of the microphone housing 11 is 0.250 inches. The microphone 12 may be forced into the housing 11. In alternative embodiments, the microphone housing 11 may have a different shape to accommodate the shape of a non-circular internal microphone 12.

The internal microphone 12 is disposed in the annular gap of the microphone housing 11 and is used to detect sounds, in, near, and/or emanating from the ear canal of the user. The internal microphone 12 converts those detections into an electrical signal that is input to the electronic device. The internal microphone 12 also has microphone leads 15 used to couple the microphone to the electronic device using the wires 4 or a wireless transmitter. Any suitable microphone may be used in the internal microphone assembly. Examples of suitable, commercially available, microphones include OWMO-4015 Series microphones manufactured by Ole Wolff Manufacturing, Inc., 150 North Michigan Avenue, Suite 2800, Chicago, Ill. 60601, and MAA-03A-L Series manufactured by Star Micronics America, Inc., 1150 King Georges Post Road, Edison, N.J. 08837.

A fiber washer 14 may be disposed within the end of the microphone housing 11 proximal to the earpiece tip 3. The fiber washer 14 may be constructed of any suitable fiber material. One example of a commercially available fiber washer suitable for this application is a Hard Fiber—Regular ANSI/ASME B18.22.1 1965 (R1998). The fiber washer 14 has a shape that compliments the shape of the microphone housing 11. In a preferred embodiment, the fiber washer 14 is circular and has outer diameter that is slightly larger than the inner diameter of the microphone housing 11. Similar to the microphone 12, the washer 14 may be forced into the housing 11. The fiber washer 14 also contains an annular gap, having an internal diameter slightly smaller than the outer diameter of a tube 7, described in detail below. In one embodiment, the internal diameter of the fiber washer is slightly less than 0.090 inches. The fiber washer 14 provides for insulation and/or sealing of the microphone housing 11, while resisting compression and helping to maintain appropriate spacing between the components of the internal microphone assembly 5.

The potting material 13 may be disposed in the end of the microphone housing 11 distal to the earpiece tip 3 to provide strain relief for the microphone leads 15 and to improve the structural stability of the internal microphone assembly 5. Additionally, the potting material 13 protects the internal microphone 12 from water and/or moisture. The term "potting," as used herein, includes the processes of potting, casting, and/or encapsulation. Potting and casting involve a method where a liquid potting compound is poured onto a device, thereby completely (or at least partially) encasing the device. Encapsulation is a process where a device is dipped into a resin system so that a thick coating surrounds the device.

The tube 7 is secured to the internal microphone assembly 5. The tube 7 has a central channel along the longitudinal axis of the tube 7. The tube 7 may be any suitable length. In one embodiment, the tube 7 with a central channel has a length of about 0.475 inches, an internal diameter of about 0.050 inches, and an outer diameter of about 0.090 inches. In one embodiment, the tube 7 is disposed in the annular gap of the fiber washer 14. The tube 7 may be forced into the annular gap of the fiber washer 14. The tube 7 may be constructed of any suitable material, such as TYGON®, PTFE, or the like. The tube 7 allows sounds to be conveyed from an ear canal of the user to the internal microphone 12 of the earset, and/or, in embodiments that follow, from an internal speaker to the ear of the user.

The tube 7 may be linear in shape. In another embodiment, the tube 7 may be non-linear in shape, such as an arcuate shape or spiraled shape. Curvilinear shapes that do not impart a cusp in the tube 7 or curve around too small of a radius will not significantly affect the acoustic properties of the tube 7. The non-linear shape may allow a tube 7 of a longer length to fit within the confines of a smaller housing 2.

Referring back to FIG. 2, the internal microphone assembly 5 is disposed within the earpiece housing 2. In the embodiment of FIG. 2, an outlet of the tube 7 is adjacent the earpiece tip 3. An opening in the earpiece housing 2 allows either the tube 7 to be located at or slightly protrude from the earpiece housing 2. The opening in the earpiece housing may be formed during the manufacture of the earpiece housing 2 itself, or the opening may be subsequently machined into the earpiece housing 2. The opening can be any desired shape to accommodate the tube 7. In one embodiment, the opening may be formed as a countersink opening, and may have a width of about 0.090 inches and a depth of about 0.030 inches. The outer diameter of the tube 7 or audio outlet 18 may also be secured to the inner diameter of the countersink opening.

The end of the tube 7 distal to the microphone assembly 5 may be coupled to a tip adapter insert 8. The tip adapter insert may be made from any suitable material, such as a plastic, rubber, or the like. The tip adapter insert 8 will also be referred to as a stem 8. The stem 8 may have a central channel that, in one embodiment, may have the same internal diameter as the channel of the tube 7. The stem 8 of the illustrated embodiment has acoustic waveguide properties in terms of amplifying desired frequencies in a sound signal and/or making other frequency spectrum modifications. The stem 8 may be any suitable length. In the illustrated embodiment, the stem 8 has a length of about 0.260 inches, and an internal diameter of about 0.050 inches. In another embodiment, the stem 8 has a length of about 0.500 inches and a diameter of about 0.050 inches. The exterior surface of the stem 8 may be threaded to have threads 9, or may have ribs, to assist in securing the earpiece tip 3 to the earpiece 1, as shown in FIG. 2. In other embodiments, the stem 8 may not have threads 9, as illustrated in FIGS. 4-10.

The stem 8 may be linear in shape. In another embodiment, the stem 8 may be non-linear in shape, such as an arcuate shape or bent shape. The non-linear shape of the stem 8 may improve the ergonomics of the earpiece by bending the earpiece tip 3 to follow the shape of the stem 8 to allow for facilitated insertion of the earpiece tip 3 into the user's ear and comfort during use. Curvilinear shapes that do not impart a cusp in the stem 8 or curve around too small of a radius will not significantly affect the acoustic properties of the stem 8.

When coupled together, the stem 8, the tube 7, and longitudinal distance between the end of the stem 8 and the earpiece tip opening 10 collectively form an acoustic pathway 6. All or part of the acoustic pathway may behave as an acoustic waveguide. Therefore, the acoustic pathway 6 may be of appropriate length, of appropriate diameter, and/or of appropriate material or construction so as to behave as an acoustic waveguide with desired properties. As discussed in detail below, the parameters of the acoustic pathway 6 may be changed, depending on the frequency that one desires to emphasize. In an embodiment where the actual length of the tube 7 is 0.475 inches and the actual length of the stem 8 is 0.260 inches the total length of the pathway 6 may be about 1.08 inches (2.75 cm).

Figure 4:
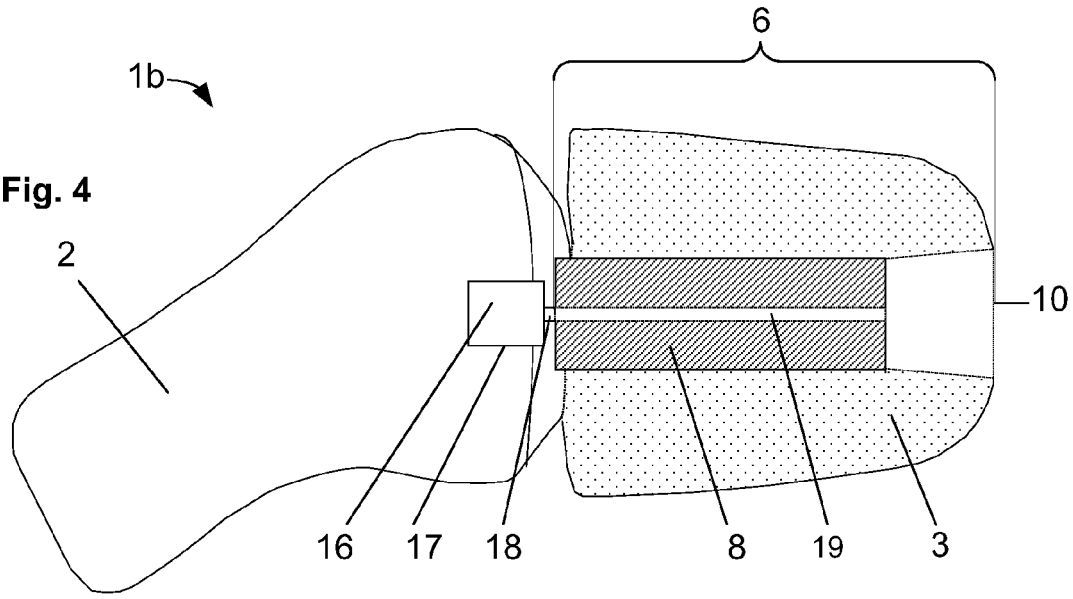
FIGS. 4-10 are partially broken away side views of various exemplary earpieces containing at least one of an internal microphone or an internal speaker.

Referring to FIG. 4, another earpiece 1*b* is illustrated. In this embodiment, the earpiece housing 2 houses an internal speaker 16. For the sake of brevity, features common to preceding embodiments will not be described. In one embodiment, the internal speaker 16 is disposed in the earpiece housing 2 and is used to output acoustic signals to the ear canal of the user. The internal speaker 16 includes a speaker housing 17 and a speaker outlet 18 that allows the sound of the internal speaker to emanate to the user. In one embodiment, the internal diameter of speaker outlet 18 is about 0.035 inches. Any suitable speaker may be used as the internal speaker of the earpiece. Examples of commercial speakers suitable for this application include ED Series speakers, BK series speakers, and CM Series speakers manufactured by Knowles, 1151 Maplewood Drive, Itasca, Ill. 60143. In the embodiment of FIG. 4, the speaker outlet is adjacent the earpiece tip 3. The end of the speaker outlet 18 proximal to the earpiece tip 3 may be coupled to a stem 8 that has a central channel 19. In one embodiment, the stem 8 has a length of about 0.500 inches and an internal diameter of about 0.035 inches. In this embodiment, the acoustic pathway 6 formed by the stem 8 and distance between the stem 8 and the tip opening 10 may be about 0.605 inches. The acoustic pathway 6 of FIG. 4 may behave as an acoustic waveguide.

Figure 5:
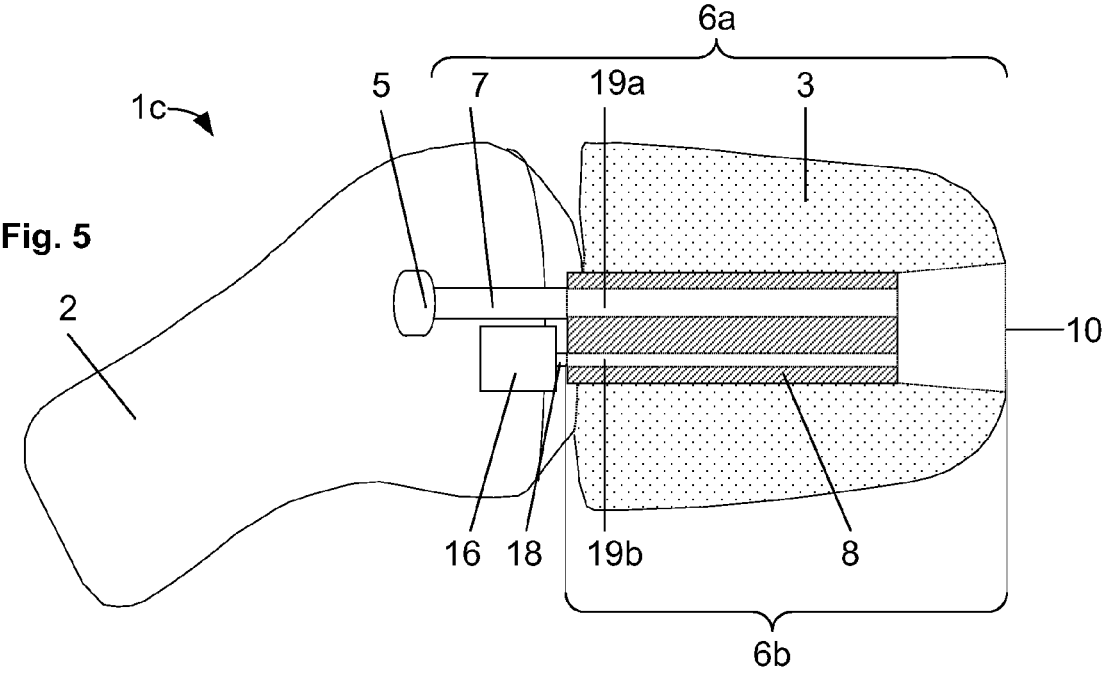

Referring to FIG. 5, another earpiece 1*c* is illustrated. In this embodiment, the earpiece housing 2 houses both an internal microphone assembly 5 and an internal speaker 16. For the sake of brevity, features common to preceding embodiments will not be described. In the embodiment of FIG. 5, the stem 8 has two channels 19*a*, 19*b* that each behave as an acoustic waveguide. One channel 19*a* is coupled to the tube 7 and the other channel 19*b* is coupled to the speaker outlet 18. Each respective through channel 19*a* and 19*b* may have the same diameter as the tube 7 and speaker outlet 18, respectively. In one embodiment, the stem 8 has a length of about 0.500 inches, a through channel 19*a* with a diameter of about 0.050 inches, and a through channel 19*b* with a diameter of about 0.035 inches. The combined length of the tube 7 and stem 8 may be about 0.975 inches. A length of a first acoustic pathway 6*a* from the microphone assembly 5 to the opening 10 may be about 2.75 cm (about 1.08 inches). A length of a second acoustic pathway 6*b* from the opening 10 to the speaker part 18 may be about 0.605 inches. Each of the acoustic pathways 6*a* and 6*b* may separately behave as acoustic waveguides.

Figure 6:
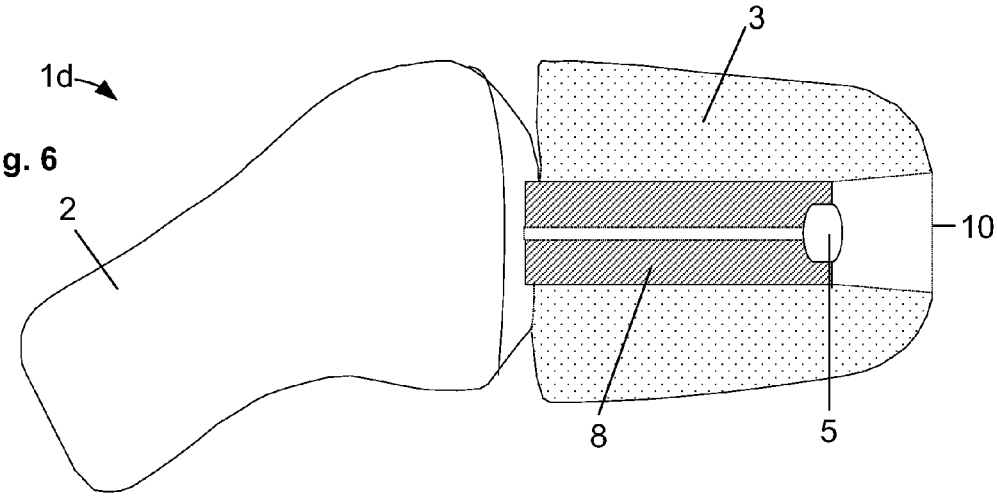
Figure 7:
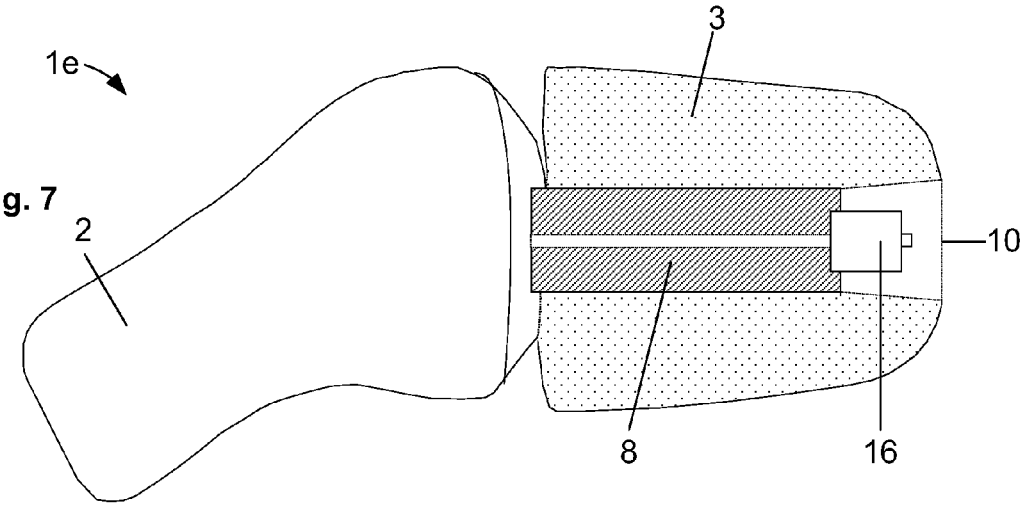

If modification to the frequency spectrum of an internal microphone and/or a loudspeaker is not desired, the earpiece may be constructed without an acoustic pathway that behaves as an acoustic waveguide. Referring to FIGS. 6 and 7, an earpiece 1*d* with an internal microphone assembly 5 and an earpiece 1*e* with an internal speaker 16 are respectively illustrated. In these embodiments the internal microphone assembly 5 and the internal speaker 16 are positioned in the tip 3 and with respect to the ear canal of a person so that sound is communicated substantially without the effect of an acoustic waveguide. This is because the acoustic pathway formed by the distance between the stem 8 and the tip opening 10 is too short to significantly affect the frequency response of the loudspeaker and microphone.

For the sake of brevity, features common to preceding embodiments will not be described. In the embodiments of FIGS. 6 and 7, a stem 8 is coupled to the earpiece housing 2. In one embodiment, the stem 8 has a length of about 0.500 inches and an internal diameter of about 0.035 inches. The internal microphone assembly 5 or internal speaker 16 is disposed in the earpiece tip 3 and secured to the stem 8, proximal to the tip opening 10. In these embodiments, the stem 8 does not function as an acoustic waveguide. Rather the channel of the stem 8 functions as a wire passage port for the wires and/or leads of the internal microphone assembly 5 or the internal speaker 16.

Figure 8:
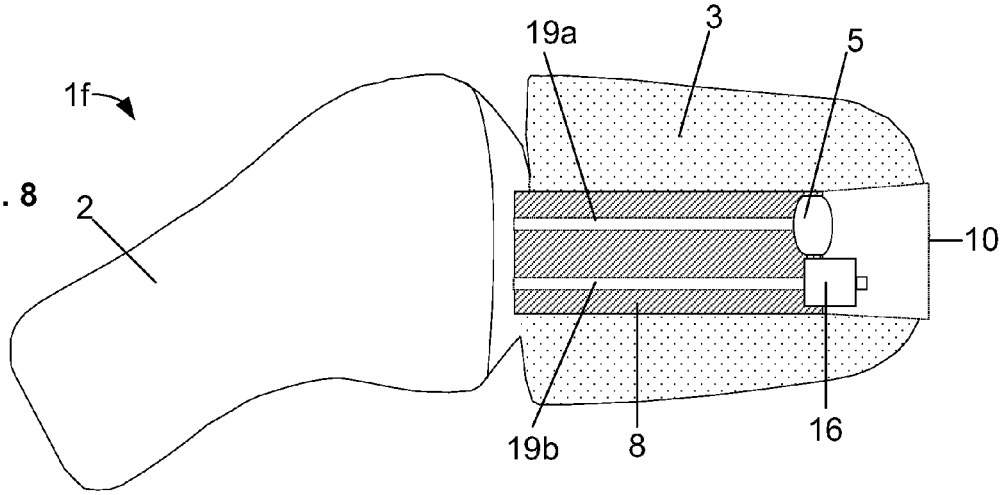

Referring to FIG. 8, another earpiece if having both an internal microphone assembly 5 and an internal speaker 16 is illustrated. Both the internal microphone assembly 5 and the internal speaker 16 are positioned in the tip 3 and with respect to the ear canal of a person so that sound is communicated without the effect of an acoustic waveguide. For the sake of brevity, features common to preceding embodiments will not be described. In the embodiment of FIG. 8, a stem 8 is coupled to the earpiece housing 2. The stem 8 includes two through channels 19*a* and 19*b*, one for the internal microphone assembly 5 and one for the internal speaker 16. In one embodiment, the stem 8 has a length of about 0.500 inches, a through channel 19*a* with a diameter of about 0.035 inches, and a through channel 19*b* with a diameter of about 0.035 inches. In this embodiment, the through channels 19*a* and 19*b* of the stem 8 respectively function as wire passage ports for the wires and/or leads of the internal microphone assembly 5 and the internal speaker 16.

Figure 9:
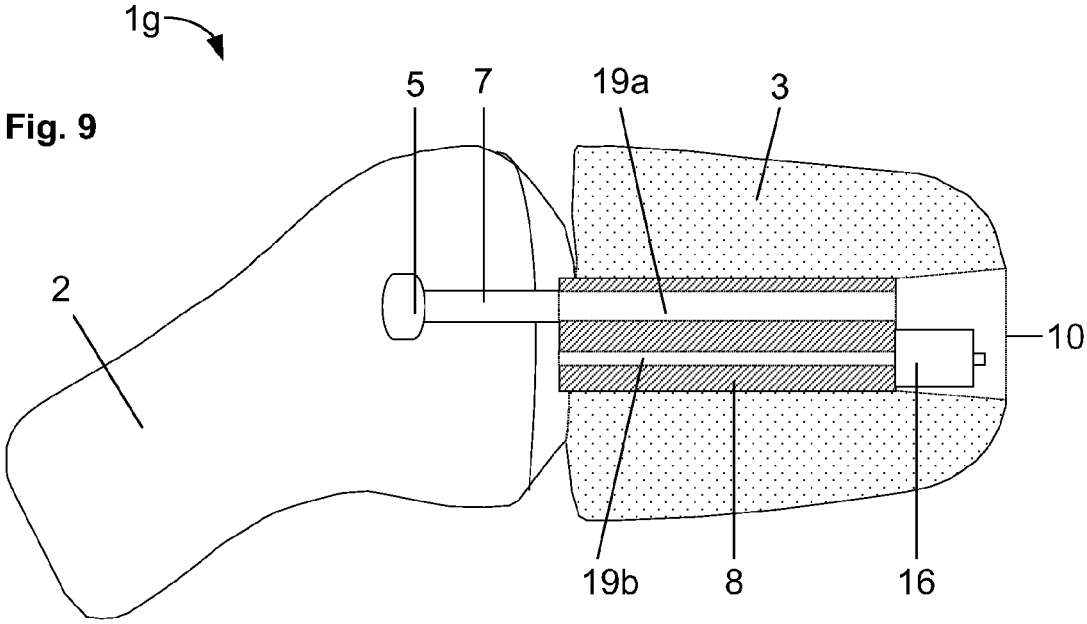
Figure 10:
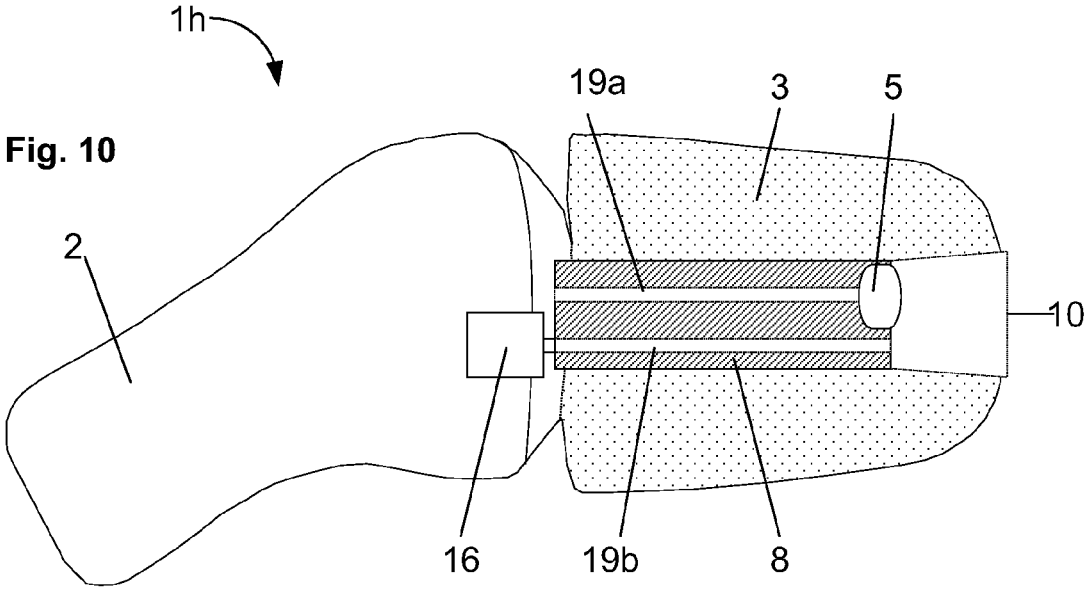

Referring to FIGS. 9 and 10, respectively shown are an earpiece 1*g* and an earpiece 1*h* that both include an internal microphone assembly 5 and an internal speaker 16. In these embodiments, however, one of the internal microphone assembly 5 or the speaker 16 has an acoustic pathway that behaves as an acoustic waveguide. For the sake of brevity, features similar to preceding embodiments will not be described. In the embodiment of FIG. 9, the acoustic pathway for the internal microphone assembly 5 behaves as an acoustic waveguide in similar manner to the embodiment of FIG. 5 and the speaker 16 is mounted to the stem 8 in similar manner to the embodiment of FIG. 7 or FIG. 8. In the embodiment of FIG. 10, the acoustic pathway for the speaker 16 behaves as an acoustic waveguide in similar manner to the embodiment of FIG. 4 or FIG. 5 and the internal microphone assembly 5 is mounted to the stem 8 in similar manner to the embodiment of FIG. 6 or FIG. 8.

III. Waveguide Acoustics

The addition of an acoustic waveguide to an earpiece assembly allows for manipulation of the resonance frequencies of the earpiece assembly to achieve amplification and/or attenuation at certain frequencies. These manipulations are achieved by varying the length, the cross-sectional area, and/or material of the acoustic waveguide. Accordingly, by changing the dimensions of the acoustic waveguide, one can optimize the performance of the earpiece, as well as customize the earpiece to meet the specific needs of a user.

A. Resonance Frequency

Resonance frequency is the frequency at which a system oscillates at its maximum amplitude. Resonant systems can be used to generate vibrations of a specific frequency, or pick out specific frequencies from a complex vibration containing many frequencies. As previously described, an internal microphone assembly and/or an internal speaker may be disposed in the earpiece housing, and either or both may be joined to an acoustic pathway that behaves as an acoustic waveguide. The following describes the derivation of a theoretical model exemplifying the performance of various embodiments of an acoustic waveguide, wherein the acoustic waveguide is modeled by a tube component.

Assuming planar wave propagation with no losses, the sound pressure p(x,t) and the volume velocity U(x,t) in a tube are related by equations 1 and 2, as derived from Newton's law and compressibility considerations, where A is the cross-sectional area of the tube at the point x, $P_O$ is the ambient pressure, ρ is the ambient density of the air (0.00114 gm/cm$^3$ for air at body temperature), and γ is the ratio of specific heat at constant pressure to specific heat at constant volume (1.4 for air).

$$\frac{\partial p(x,t)}{\partial x} = -\frac{\rho}{A(x)}\frac{\partial U(x,t)}{\partial t} \quad \text{Eq. 1}$$

$$\frac{\partial U(x,t)}{\partial x} = -\frac{A(x)}{\gamma P_O}\frac{\partial p(x,t)}{\partial t} \quad \text{Eq. 2}$$

Assuming exponential dependence on time, $p(x,t)=p(x)e^{j2\pi ft}$ and $U(x,t)=U(x)e^{j2\pi ft}$, where p(x) and U(x) represent complex amplitudes of sound pressure and volume velocity respectively, and f represents frequency. Insertion of p(x,t) and U(x,t) into equations 1 and 2 is represented by equations 3 and 4.

$$\frac{dp(x)}{dx} = -\frac{j2\pi f\rho}{A(x)}U(x) \quad \text{Eq. 3}$$

-continued $$\frac{dU(x)}{dx} = -\frac{j2\pi fA(x)}{\gamma P_O}p(x) \quad \text{Eq. 4}$$

Elimination of U(x) by the combination of equations 3 and 4 is represented by equation 5, where k=2πf/c, and $$c = \sqrt{\frac{\gamma P_O}{\rho}}$$

is the velocity of sound. For air at the temperature of the body, c is equal to 35,400 cm/s.

$$\frac{d^2p(x)}{dx^2} + \frac{1}{A(x)}\frac{dA(x)}{dx}\frac{dp(x)}{dx} + k^2p = 0 \quad \text{Eq. 5}$$

For uniform tubes, A(x) is equal to constant A, and equation 5 reduces to the one-dimensional wave equation as represented by equation 6.

$$\frac{d^2p(x)}{dx^2} + k^2p = 0 \quad \text{Eq. 6}$$

A generalized solution equation 6 yields p(x), as represented by equation 7.

$$p(x)=p_m\sin(kx)+q_m\cos(kx) \quad \text{Eq. 7}$$

Substitution of equation 7 into equation 4 yields U(x), as represented by equation 8.

$$U(x) = j\frac{A}{\rho ck}\frac{dp(x)}{dx} = j\frac{A}{\rho c}(p_m\cos(kx) - q_m\sin(kx)) \quad \text{Eq. 8}$$

Figure 11:
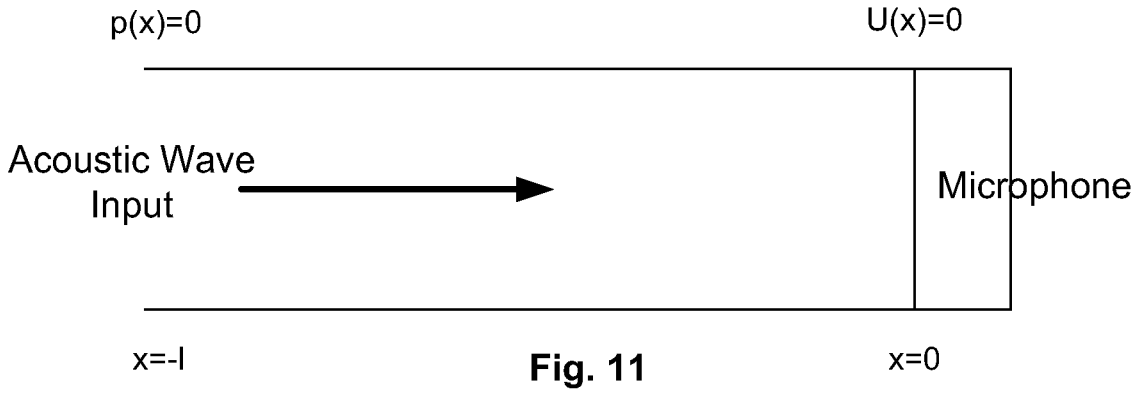
FIG. 11 is a representation of a uniform tube, where one end is open and the other end is rigidly blocked by a microphone.

FIG. 11 represents a uniform tube, where one end of the tube is opened to receive acoustic wave input and the other end is rigidly blocked by a microphone. For such a tube, the boundary conditions are: p(x)=0 at x=−l and U(x)=0 at x=0. Because U(x)=0 at x=0, it is implied that $p_m$=0. Therefore, the substitution of these boundary conditions into equations 7 and 8 yield equations 9 and 10, the solution for the one-dimensional wave equation for such a tube.

$$U(x) = -j\frac{A}{\rho c}q_m\sin(kx) \quad \text{Eq. 9}$$

$$p(x) = q_m\cos(kx) \quad \text{Eq. 10}$$

The boundary condition at x=−l is satisfied when cos(kl)=0, or if $$\frac{2\pi fl}{c} = \frac{(2n-1)\pi}{2},$$

where n is an integer. Therefore, the formant frequencies of the tube of FIG. 11 are represented by equation 11, where the formant frequencies of the tube may be controlled by changing the length of the tube.

$$F_n = \frac{2n-1}{4}\frac{c}{l} \quad \text{Eq. 11}$$

For example, if l=2.75 cm, $$F_n = \frac{2n-1}{4} \times \frac{35400}{2.75}\ \text{Hz},$$

or approximately 3218 Hz, 9654 Hz, 16090 Hz, . . . , for n=1, 2, 3, . . . , respectively.

Figure 12:
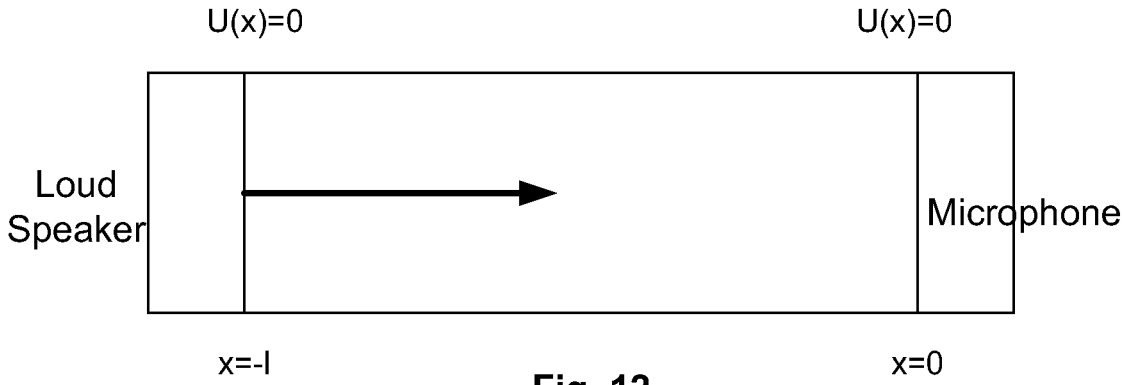
FIG. 12 is a representation of a uniform tube, where one end is rigidly blocked by a loudspeaker and the other end is rigidly blocked by a microphone.

FIG. 12 represents another uniform tube, where one end of the tube is rigidly blocked by a loudspeaker and the other end is rigidly blocked by a microphone. For such a tube, the boundary conditions are: U(x)=0 at x=0 and x=−l. Because U(x)=0 at x=0, it is implied that $p_m$=0. Therefore, as with the embodiment in FIG. 11, the solution for the one-dimensional wave equation for such a tube at the boundary condition is represented by equations 9 and 10. However, in this embodiment, the boundary condition at x=−l is satisfied when sin (kl)=0, or if $$\frac{2\pi fl}{c} = n\pi,$$

where n is an integer. Therefore, the formant frequencies of the tube of FIG. 12 are represented by equation 12, where the resonant frequencies of the tube where both ends are rigidly blocked may be controlled by changing the length of the tube.

$$F_n = \frac{n}{2}\frac{c}{l} \quad \text{Eq. 12}$$

For example, if l=8.25 cm, $$F_n = \frac{n}{2} \times \frac{35400}{8.25}\ \text{Hz},$$

or approximately 2145 Hz, 4291 Hz, 6436 Hz, . . . , for n=1, 2, 3, . . . , respectively.

B. Amplification Properties

The amplification provided by the acoustic waveguide depends on the loss characteristics of the acoustic waveguide. Higher losses lead to wider bandwidths, which, therefore implies a smaller amplification at the resonant frequency. On the other hand, smaller losses lead to narrower bandwidths and, therefore, larger amplification for the resonant frequencies. The loss characteristics of the acoustic waveguide may be controlled by varying the cross-sectional area and the material of the component(s) that behaves as the acoustic waveguide.

Various losses may be a factor in the acoustic waveguide performance. For example, the loss characteristic of a uniform tube may be influenced by the finite impedance of the walls of the tube. The increase in bandwidth of the resonances due to the resistive component of the finite impedance of the walls of the tube is represented by equation 13, where $G_{sw}$=the specific acoustic conductance (i.e., conductance per unit area) of the walls, A=cross-sectional area of the uniform tube, and S=cross-sectional perimeter of the uniform tube.

$$B_w = \frac{G_{sw}S\rho c^2}{2\pi A} \quad \text{Eq. 13}$$

The loss characteristic of the tube may also be influenced by viscous friction at the walls of the tube. The increase in bandwidth of the resonances due to viscous friction at the walls of the tube is represented by equation 14, where $$R_V = \frac{S}{A^2}\sqrt{\frac{\omega\rho\mu}{2}},$$

ω=2πf, and μ=coefficient of viscosity=$1.86\times10^{-4}$ poise (dyne-s/$cm^2$).

$$B_V = \frac{R_V A}{2\pi\rho} \quad \text{Eq. 14}$$

Additionally, the loss characteristic of the tube may be influenced by heat conduction at the walls of the tube. The increase in bandwidth of the resonances due to heat conduction loss at the walls of the tube is represented by equation 15, where $$G_h = S\frac{0.4}{\rho c^2}\sqrt{\frac{\lambda\omega}{2c_p\rho}},$$

λ=coefficient of heat conduction=$5.5\times10^{-5}$ cal/cm-s-degree, and, $c_p$=specific heat of air at constant pressure=0.24 cal/gm-degree.

$$B_h = \frac{G_h\rho c^2}{2\pi A} \quad \text{Eq. 15}$$

Equations 13 to 15 demonstrate that the increase in bandwidth is inversely proportional to the cross-sectional area of the tube. Thus, tubes with small cross-sectional area will have high losses and therefore, wide bandwidths, whereas tubes with large cross-sectional areas will have small losses and therefore, narrow bandwidths. An estimate of the combined increase in bandwidth due to these losses may be obtained by summing the contributions of each of the above three effects. Also, note that these losses will also have some impact on the exact location of the resonant peak.

C. Experimental Results

Experiment 1

Figure 13:
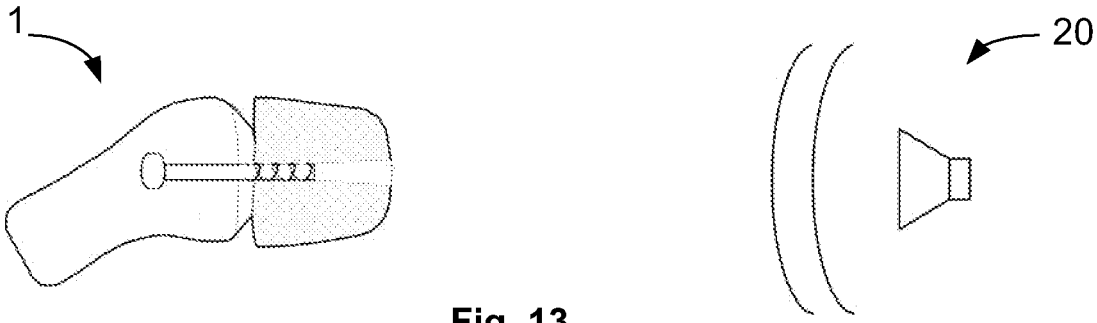
FIG. 13 is a representation of an experimental test platform that includes an earpiece similar to that in FIG. 2 and a laboratory loudspeaker.

Referring to FIG. 13, a representation of an experiment test platform is illustrated. The platform includes an earpiece 1 similar to that of FIG. 2 and a laboratory loudspeaker 20. The experiment is conducted with two different earpieces, each having an acoustic pathway of a different length.

A reference white noise is played at 84 dBA with the laboratory loudspeaker 20 and recorded through the internal microphone assembly 5 of the earpiece 1. The effective length of the acoustic pathway is measured from the tip of the foam tip to the microphone, which includes the length of foam tip's opening, stem, and tube made of TYGON (e.g., Tygon® Chemflour® PFA tubing). Two acoustic pathways with effective lengths of 1.8 cm and 2.75 cm are tested in the experiment for evaluating the resonance frequency when attached to the microphone. In the experiment, the internal diameter of the tubes 7 is 1.27 mm. The lengths of the tubes 7 are 0.26 cm and 1.21 cm, respectively. Each tube 7 is coupled to a stem 8 and earpiece tip 3, the stem 8 and distance between the stem 8 and the tip opening 10 having a length of about 1.54 cm. Therefore, the formed acoustic pathways have effective lengths of 1.8 cm and 2.75 cm, respectively.

Figure 14:
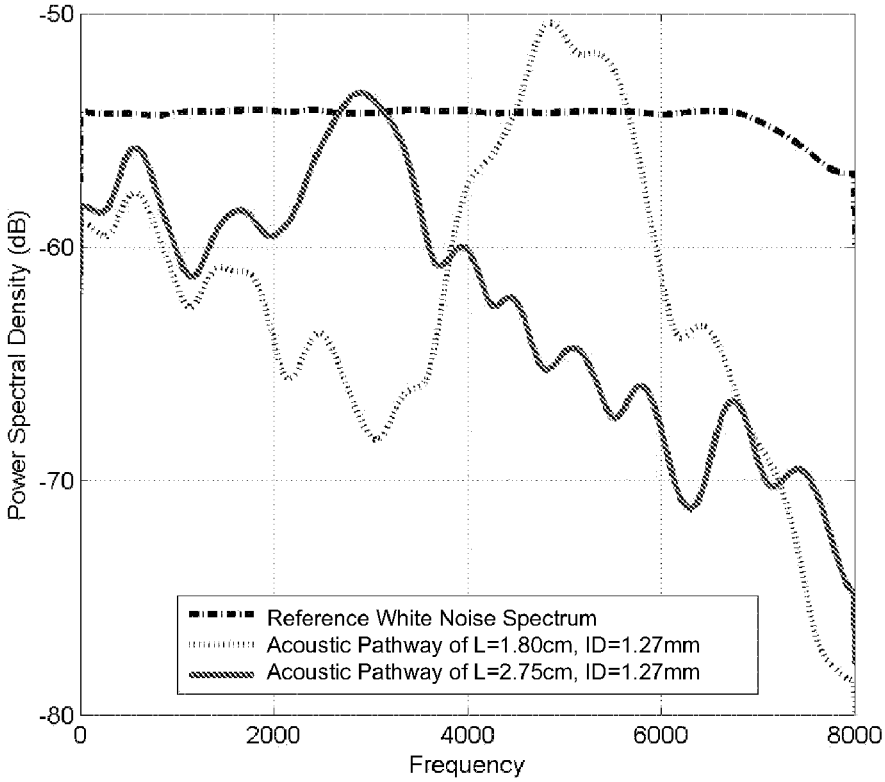
FIG. 14 is a plot of power spectral density of a reference white noise signal as recorded over a given frequency range with the test platform of FIG. 13 in which the tube length is varied.

Referring to FIG. 14, a plot of the power spectral density of the reference white noise of length 10 seconds, power spectral density of white noise recorded by the earpiece with the 1.8 cm pathway, and power spectral density of white noise recorded by the earpiece with the 2.75 cm pathway is shown. FIG. 14 demonstrates the effect the length of the acoustic waveguide has on shaping the white noise spectrum. For the earpiece with the 2.75 cm pathway, the first prominence is at about 2890 Hz. For the earpiece with the 1.8 cm pathway, the first prominence is at about 4860 Hz. Therefore, the longer the tube is in length, the lower the first peak is in frequency.

Based on the theory, the first resonance of the acoustic pathway will be at frequency $f=c/4l$. If the length of the pathway is 1.8 cm, then the resonance should be at a frequency of 4916 Hz (assuming $c=35400$ cm/s). If the length of the pathway is increased to 2.75 cm, then the resonance should be at a frequency of 3218 Hz. Therefore, the measured resonance frequencies are close to the theoretical values, and support the theory that changing the length of the acoustic pathway helps in amplifying frequencies in the desired frequency range.

Experiment 2

Figure 15:
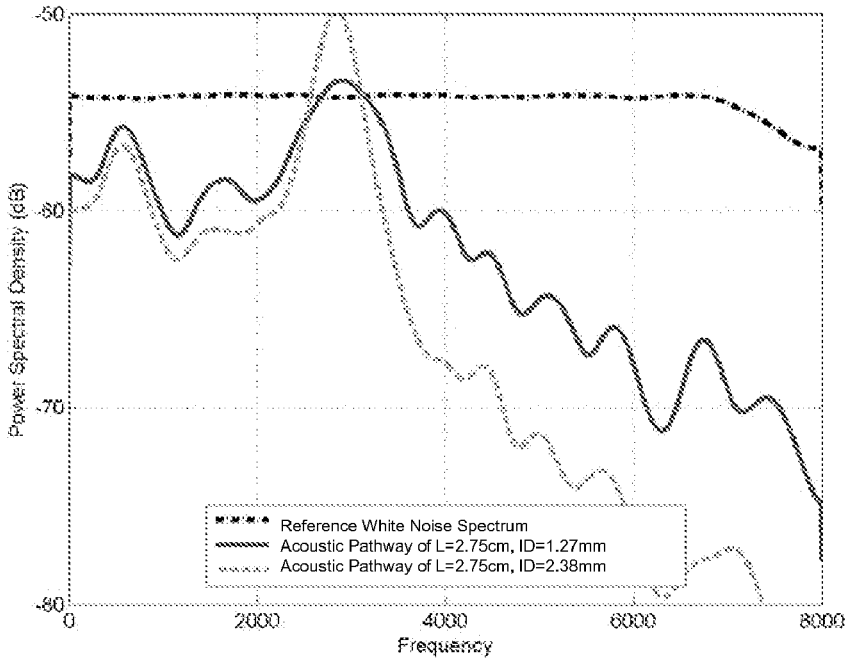
FIG. 15 is a plot of power spectral density of a reference white noise signal as recorded over a given frequency range with the test platform of FIG. 13 in which the tube diameter is varied.

An experiment similar to experiment 1 is conducted to test amplification properties of the acoustic waveguide. In this experiment, the test platform of FIG. 13 is used and white noise is recorded with a microphone using two tubes 7 of varying cross-sectional area. A tube 7 with an internal diameter of 1.27 mm and another tube 7 with an internal diameter of 2.38 mm, respectively, are tested. Each tube 7 is coupled to a stem 8 having an internal diameter of equivalent to the respective tube and earpiece tip 3, thereby forming an acoustic pathway 6. Both acoustic pathways 6 have the same effective length of 2.75 cm. Referring to FIG. 15, a plot of the power spectral density of the reference white noise of length 10 seconds, power spectral density of white noise recorded by the earpiece with the 1.27 mm tube, and power spectral density of white noise recorded by the earpiece with the 2.38 mm tube is shown. As predicted by theory, the tube with the internal diameter of 2.38 mm has lower losses (exhibited by sharper peaks) and higher amplitude than the tube with an internal diameter 1.27 mm. Furthermore, the resonance frequencies of both tubes are not very different.

One may conclude from the results of experiments 1 and 2 that one embodiment of an acoustic pathway for a microphone assembly 5 of an earpiece 1 may have an effective length of about 2.75 cm (about 1.08 inches) and a component or components with an internal diameter of about 1.27 mm (about 0.05 inches), such as is found in the embodiments of FIGS. 2, 5, and 9.

Experiment 3

Figure 16:
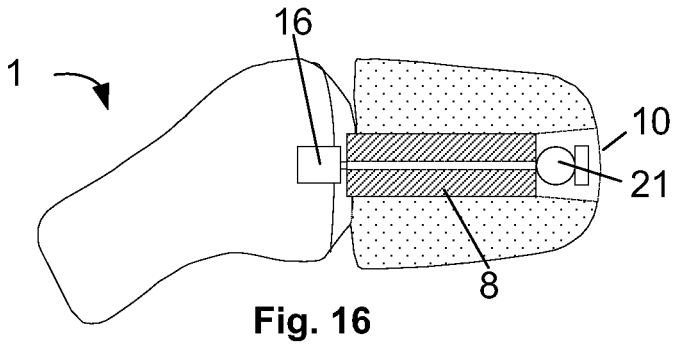
FIG. 16 is a representation of an experimental test platform that includes an earpiece similar to that in FIG. 4 and a laboratory microphone.

Referring to FIG. 16, a representation of an experiment test platform is illustrated. The platform includes an earpiece 1 similar to that of FIG. 4, wherein a laboratory microphone 21 is disposed in the tip opening 10 of the earpiece 1, very close to the end of the stem 8 distal to the internal speaker 16. An experiment is performed by playing white noise of 84 dBA with the internal loudspeaker of the earpiece, and the sound is recorded by the laboratory microphone 21. Two stems 8 with lengths of 1.27 cm and 8.25 cm are tested to evaluate the resonance frequency of the waveguide formed by the channels of the stems 8 when attached to the loudspeaker 16. Both channels have the same internal diameter of 3.17 mm.

Figure 17:
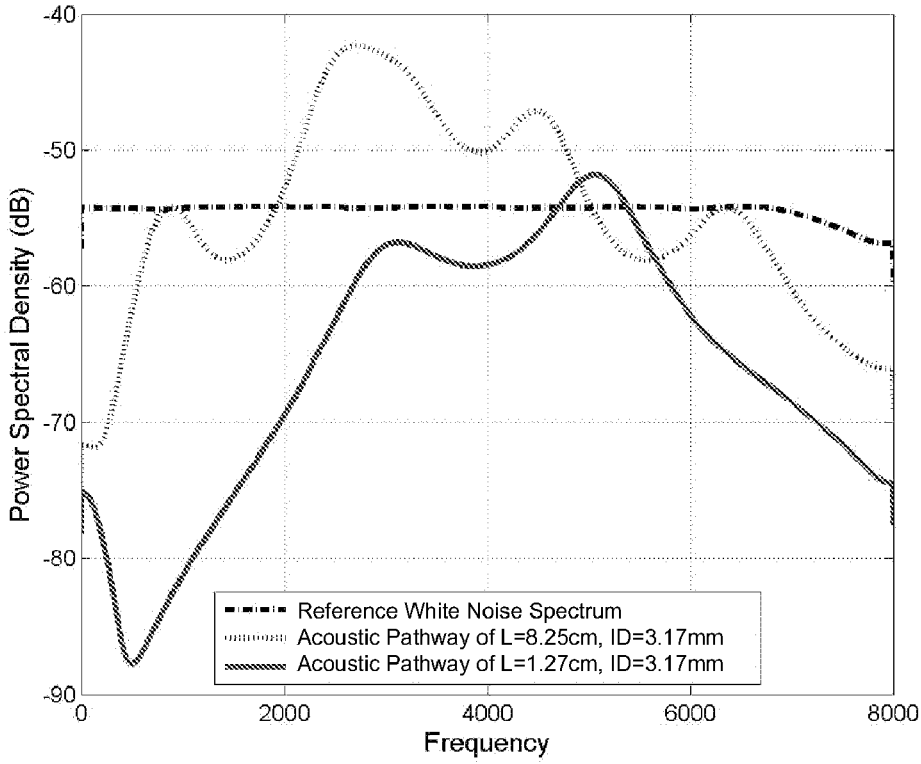
FIG. 17 is a plot of power spectral density of a reference white noise signal as recorded over a given frequency range with the test platform of FIG. 16 in which the tube length is varied.

Referring to FIG. 17, a plot of the power spectral density for the input white noise of length 10 seconds, power spectral density of white noise recorded at the tip of the channel with a length of 1.27 mm, and power spectral density of white noise recorded at the tip of the channel with a length of 8.25 cm is shown. FIG. 17 demonstrates the effect of the length of the acoustic waveguide defined by the stem 8 has on shaping the white noise spectrum. The waveguides with length of 1.27 cm and 8.25 cm have peaks at 5060 Hz and 2600 Hz, respectively.

The theoretical value of the first resonance frequency is at $f=c/2l$. The theoretical values are 13937 Hz and 2145 Hz for the acoustic stems with length of 1.27 cm and 8.25 cm, respectively. The measured resonance frequency is close to the theoretical value for the stem with length of 8.25 cm. However, there is a significant deviation between the theoretical value and experimental value for the stem with length of 1.27 cm. This may be explained by the fact that the shorter stem has a smaller acoustic impedance, relative to the loudspeaker impedance. Therefore, the stem cannot significantly affect the frequency response of the loudspeaker. Due to the same reason, as the ratio of stem length to internal diameter decreases, the effect on the frequency response of the loudspeaker becomes smaller until, when the stem length is less than the internal diameter, there is no effect at all. This characteristic is also observed in the microphone coupling tubes of Experiment 1 where a short tube cannot significantly affect the frequency response of microphone. However, the overall results support the theory that increasing (or reducing) the length of the acoustic waveguide may reduce (or increase) the resonance frequency to the desired frequency range.

Experiment 4

Figure 18:
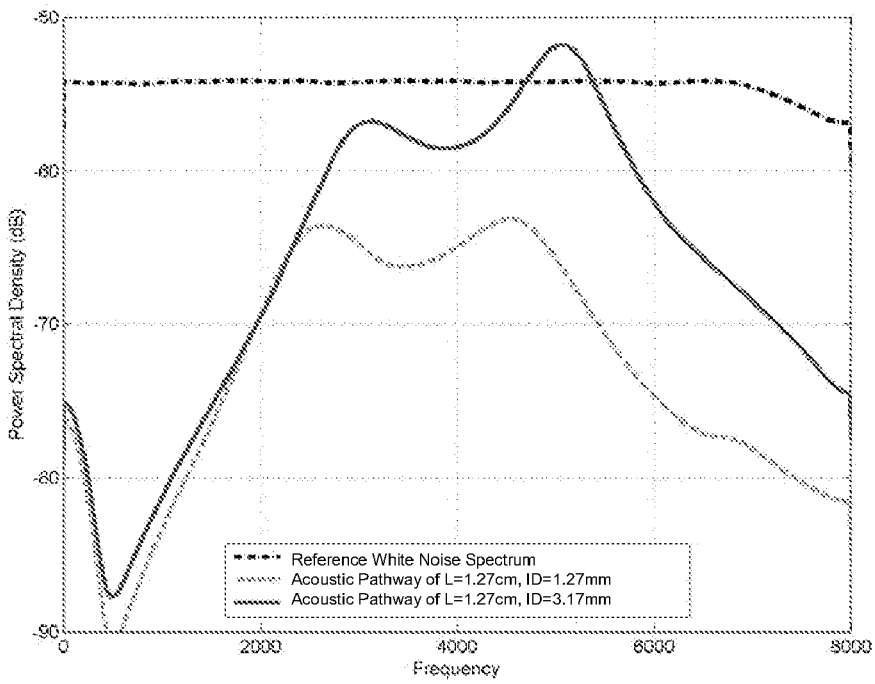
FIG. 18 is a plot of power spectral density of a reference white noise signal as recorded over a given frequency range with the test platform of FIG. 16 in which the tube diameter is varied.

An experiment similar to experiment 3 is conducted to test the amplification properties of the acoustic waveguide. The experimental setup is similar to that of Experiment 3, and is represented by FIG. 16. The laboratory microphone 21 is placed very close to the end of the stem 8 distal to the internal speaker 16. Two channels with internal diameter of 1.27 mm and internal diameter of 3.17 mm are tested. Both channels have the same length of 1.27 cm. Referring to FIG. 18, a plot of the power spectral density of the reference white noise of length 10 seconds, power spectral density of white noise recorded by the earpiece with the 1.27 mm stem, and power spectral density of white noise recorded by the earpiece with the 3.17 mm stem is shown. As predicted by theory, the stem with the internal diameter of 3.17 mm has lower losses (exhibited by sharper peaks) and higher amplitude than the stem with an internal diameter 1.27 mm. Furthermore, the resonance frequencies of both stems are not very different.

One may conclude from the results of experiments 3 and 4 that one embodiment of an acoustic pathway for a speaker 16 of an earpiece may have a stem with a length of about 1.27 cm (about 0.5 inches) and an internal diameter of 1.27 mm (or about 0.05 inches), such as is found in the embodiments of FIGS. 4, 5, and 10.

IV. Earset Apparatus

Any of the earpieces previously described may be used in combination with one another as part of an earset apparatus that allows a user to listen to audio playback as well as engage in bidirectional communication. For purposes of brevity, not all possible combinations of earpiece embodiments are specifically described and/or illustrated in the earset assembly. However, it should be appreciated that the earset assembly may include any combination of the above-described earpieces.

Figure 19:
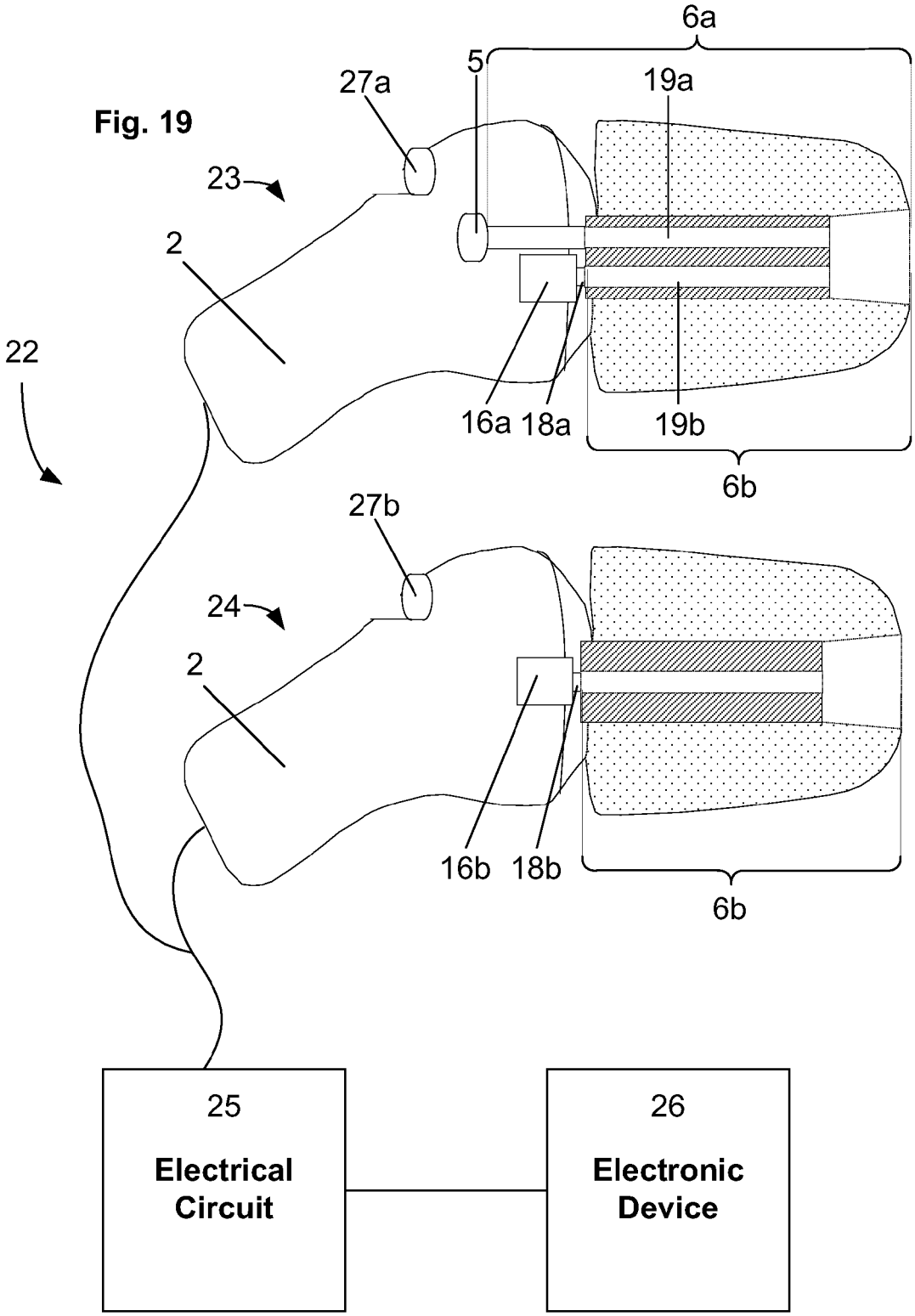
FIG. 19 is an exemplary earset assembly having a first earpiece, a second earpiece, and an electrical circuit, where the earset assembly is interfaced with an electronic device.

Now referring to FIG. 19, an earset assembly 22 that include a first earpiece 23, a second earpiece 24, and a circuit 25 is shown. The assembly 22 may operatively connect to and exchange signals with an electronic device 26. The interface between the earset assembly 22 may be a wired interface as depicted in the attached drawings or a wireless interface. The exemplary embodiment of the first earpiece 23 is similar to the earpiece of FIG. 5 and includes both an internal microphone assembly 5 and an internal speaker 16*a*, wherein the stem 8 is secured to both the tube 7 and speaker output 18*a*. The stem 8 functions as part of an acoustic pathway 6*a* between the microphone and the ear canal of the user and an acoustic pathway 6*b* between the speaker 16*a* and the ear canal of the user. Also, the respective pathways 6*a* and 6*b* behave as acoustic waveguides for the microphone 5 and the speaker 16*a*. The exemplary embodiment of the second earpiece 24 is similar to the earpiece of FIG. 4 and includes an internal speaker 16*b*, wherein the stem 8 is secured to the speaker output 18*b*. The stem 8 functions as part of an acoustic pathway 6*b* between the speaker 16*b* and ear canal of the user, and behaves as an acoustic waveguide for the speaker 16*b*.

The first and second earpieces operatively connect to an electronic device 26 through the electrical circuit 25. The electronic device 26 may be any suitable device capable of being used in conjunction with the earset assembly 22. The electronic device 26 may be, for example, a communication device, a voice recognition device, a speech recognition device, a controlling device, or the like.

The electrical circuit 25, which will be discussed in greater detail below, switches between an audio listening state and a communication state. In the audio listening state, the electrical circuit 25 is configured to operatively couple the internal speakers 16 of the first and second earpieces to the electronic device 26 for listening to stereo audio playback of audio content, and the microphone of the internal microphone assembly 5 is switched to an off state. The playback may be of recorded audio content that is stored by the electronic device 26 or may be audio content that is received by the electronic device 26, such as with a radio or data receiver. In the communication state, the electrical circuit 25 is configured to switch the internal microphone 5 of the first earpiece 23 to an on state for voice communication, and switch the internal speaker 16*a* of the first earpiece 23 to an off state while maintaining the operative coupling of the internal speaker 16*b* of the second earpiece 24 to the electronic device. In this manner, the user may use the electronic device 26 to engage in voice communications. Speech from the user may be detected with the microphone 5 and input to the electronic device 26 for transmission. Received sounds (e.g., from a remote person involved in the voice communication) may be output from the electronic device 26 to the speaker 16*b*.

An external microphone 27 may be included with either or both of the first and second earpieces 23, 24. The external microphones 27 are used to detect ambient sound, such as sounds from the surrounding environment or the voice of a co-located person with whom the user is speaking. The detected sound may be output to the user with at least one of the internal speakers 16. The external microphones 27 may be retained by the earpiece housing 2 in any suitable fashion and may be secured to any location of the earpiece housing 2 so long as the external microphones 27 are capable of detecting ambient sound. For example, a cooperating shape capable of accommodating an external microphone may be incorporated into the earpiece housing 2 during its manufacture, or a hole may be machined into the earpiece housing 2 in which the external speaker is secured. In one embodiment, the electrical circuit 25 enables the user to switch between listening to ambient sound detected by the microphone(s) 27 and the playback of audio. It should further be appreciated that an external microphone 27 may be included in any one of the previous embodiments of the earpiece assembly.

Figure 20:
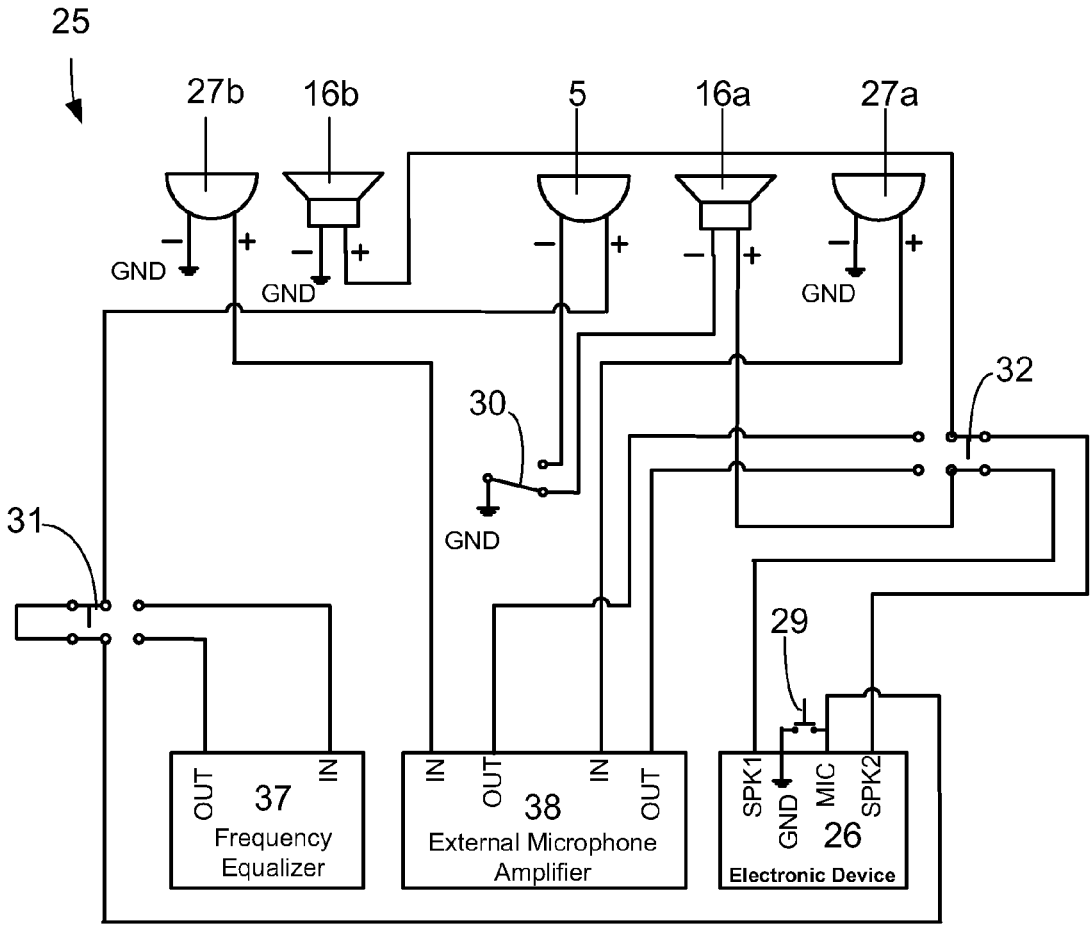
FIG. 20 is an exemplary schematic diagram of the electrical circuit of FIG. 19.

Referring to FIG. 20, an exemplary schematic of the electrical circuit 25 is illustrated. The electrical circuit 25 couples the internal microphone and internal speakers of the first and second earpieces to the electronic device 26. The electronic device 26 may have a first speaker output port (SPK1), a second speaker output port (SPK2), a microphone input port (MIC), and a ground port (GND). The internal microphone 5 of the first earpiece is coupled to the MIC port of the electronic device, the internal speaker 16*a* of the first earpiece is coupled to the SPK1 output port of the electronic device, and the internal speaker 16*b* of the second earpiece is coupled to the SPK2 output port of the electronic device.

The electrical circuit 25 includes a hook condition switch 29 that selectively couples the MIC port and GND port, and provides an on-hook or off-hook condition of the electronic device 26, similar to a conventional telephone. In one embodiment, the hook condition switch 29 is a push-button switch. However, the hook condition switch 29 may be any suitable switch. In another embodiment, for example, the on-hook/off-hook condition is instead controlled by executable logic or a programmed controller. When the hook condition switch 29 is in an open state, the switch provides an on-hook condition. When the hook condition switch 29 is in a closed state, a resistance short is created between the internal microphone port (MIC port) and the ground port (GND port) of the electronic device 26 to establish an off-hook condition.

The electrical circuit 25 further includes an audio state switch 30 that selectively couples either the internal speaker 16*a* or the internal microphone 5 of the first earpiece to ground. In one embodiment, the audio state switch 30 is a single-pole double-throw switch. However, the audio state switch 30 may be any suitable switch. In another embodiment, for example, the audio state is instead controlled by executable logic or a programmed controller. When the earset is in the audio listening state, the audio state switch 30 effectively completes the circuit connection of the internal speaker 16*a* with the electronic device 26, thereby activating the internal speaker 16*a* and deactivating the internal microphone 5. When the earset is in the communication state, the audio state switch 30 effectively completes the circuit connection of the internal microphone 5 with the electronic device 26, thereby activating the internal microphone 5 and deactivating the internal speaker 16*a*. This switching allows the user to engage in bidirectional communication while minimizing echoing or feedback caused by having both the internal microphone 5 and internal speaker 16*a* of the first earpiece activated at the same time.

It will be understood that both the hook condition switch 29 and the audio state switch 30 can be controlled independent of one another, or may be controlled in a coordinated manner.

A frequency equalizer 37 may be incorporated into the electrical circuit 25. In one embodiment, the internal microphone 5 and the MIC port of the electronic device may be coupled through the frequency equalizer 37. The frequency equalizer 37 may provide frequency equalization for the purpose of shaping a desired frequency envelope on the captured signal from the internal microphone 5. The frequency equalizer 37 may compensate for differences in detected speech from the ear canal of the user relative to if the speech had been detected from the mouth of the user. In the illustrated embodiment, the frequency equalizer 37 may be bypassed with a frequency equalization switch 31. In one embodiment, the frequency equalization switch 31 is a double-pole double-throw switch. However, the frequency equalization switch 31 may be any suitable switch. In another embodiment, for example, frequency equalization is controlled by executable logic or a programmed controller. The frequency equalization switch 31 switches between a bypass mode, in which the internal microphone 5 is coupled to the electronic device 26 without the frequency equalizer 37, and a frequency equalization mode, in which the internal microphone 5 is coupled to the electronic device 26 through the frequency equalizer 37.

One or more external microphones 27 may also be incorporated into the electrical circuit 25 for purposes of listening to ambient sound. An external sound control switch 32 may be used to selectively couple either the external microphones 27 or the SPK1 and SPK2 ports of the electronic device 26 to the internal speakers 16. The external sound control switch 32 may provide the user the option of switching between an output from the electronic device 26 during audio playback (or during bidirectional communication) and an output from the external microphones 27. For example, if a user is listening to audio playback or is engaged in bidirectional voice communication, the user may switch the external sound control switch 32, thereby allowing the user to listen to ambient sound instead of the audio playback or conversation involving the electronic device 26. In one embodiment, the external sound control switch 32 is a double-pole double-throw switch. However, the external sound control switch 32 may be any suitable switch. In another embodiment, for example, the external sound control is controlled by executable logic or a programmed controller. In the illustrated embodiment, when the external microphones 27 are used during bidirectional communication, the signal representation of ambient sound is only output by the internal speaker 16*b* of the second earpiece. However, an audio mixer may be added so that signals from the external microphones 27 may be combined with signals from the electronic device 26 during either or both of audio playback or voice communications. In one embodiment, the representation of ambient sound detected by the external microphone(s) 27 may be passed through an external microphone amplifier 38 that is used to control (e.g., amplify or attenuate) the amplitude of the signal captured by the external microphone(s) 27 before being output by the internal speakers.

In an embodiment where both the first and second earpieces include external microphones, the audio signal representation of ambient sound of the external microphone 27*a* retained by the first earpiece may be output to the user with the internal speaker 16*a* of the first earpiece, and the audio signal representation of ambient sound of the external microphone 27*b* retained by the second earpiece may be output to the user with the internal speaker 16*b* of the second earpiece. This arrangement may mimic the natural hearing of ambient sounds. In another embodiment, only one of the first or second earpieces may include an external microphone 27, and the audio signal representation of ambient sound of the external microphone 27 may be output to the user with either or both of the internal speaker(s) of the first and second earpieces.

IV. Conclusion

Although particular embodiments of the invention have been described in detail, it is understood that the invention is not limited correspondingly in scope, but includes all changes, modifications, and equivalents coming within the spirit and terms of the claims appended hereto.

What is claimed is:

1. An earset assembly, comprising:

a first earpiece having an internal microphone to capture speech of a user and an internal speaker, the first earpiece positionable with respect to a first ear of the user so that the internal microphone detects the speech from the first ear of the user;

a second earpiece having an internal speaker, the second earpiece positionable with respect to a second ear of the user; and an electrical circuit operatively connecting the internal microphone and the internal speakers to a communication device, wherein:

in an audio listening state, the circuit is configured to operatively couple the internal speakers respectively to first and second audio ports of the communication device for outputting stereo audio content with the speakers, and the internal microphone is switched to an off state; and in a communication state, the circuit is configured to switch the internal speaker of the first earpiece to an off state, switch the internal microphone of the first earpiece to an on state for voice communication and operatively couple the internal microphone to a microphone port of the communication device, and maintain the operative coupling of the internal speaker of the second earpiece to the respective audio port for use in the voice communication.

2. The earset assembly of claim 1, further comprising a frequency equalizer to apply frequency equalization to the speech captured by the internal microphone.

3. The earset assembly of claim 2, further comprising a frequency equalization switch that switches the coupling of the microphone to the microphone port between bypassing the frequency equalizer and coupling the internal microphone to the communication device through the frequency equalizer to perform the frequency equalization on the captured speech of the user.

4. The earset assembly of claim 1, further comprising a hook condition switch to provide an on-hook condition or an off-hook condition of the communication device.

5. The earset assembly of claim 4, wherein the hook condition switch creates a resistance short between the microphone port and a ground port of the communication device to establish the off-hook condition.

6. The earset assembly of claim 4, further comprising an audio state switch that selectively switches between the operative coupling of the internal speaker of the first earpiece for the audio listening state, and the operative coupling of the internal microphone for the communication state.

7. The earset assembly of claim 4, further comprising a frequency equalizer to apply frequency equalization to the speech captured by the internal microphone.

8. The earset assembly of claim 1, further comprising an audio state switch that selectively switches between the operative coupling of the internal speaker of the first earpiece for the audio listening state, and the operative coupling of the internal microphone for the communication state.

9. The earset assembly of claim 1, wherein at least one of the first or second earpieces includes an external microphone to generate an audio signal representation of ambient sound.

10. The earset assembly of claim 9, wherein the representation of the ambient sound is output to the user with at least one of the internal speakers.

11. The earset assembly of claim 9, further comprising an external microphone amplifier that controls amplitude of the audio signal representation of ambient sound.

12. The earset assembly of claim 9, wherein the external microphone is a part of the first ear piece.

13. The earset assembly of claim 12, wherein a second external microphone generates an audio signal representation of ambient sound, and is a part of the second earpiece.

14. The earset assembly of claim 13, wherein the audio signal representation of ambient sound of the first external microphone is output to the user with the internal speaker of the first earpiece and the audio signal representation of ambient sound of the second external microphone of the second earpiece is output to the user with the internal speaker of the second earpiece.

15. The earset assembly of claim 1, wherein the first earpiece includes an acoustic waveguide between the internal microphone and an ear canal of the user.

16. The earset assembly of claim 1, wherein the earpieces each include an acoustic waveguide between the speaker and the ear canal of the user.

17. A method of audio playback and voice communication, comprising:

in an audio listening state, outputting stereo audio content to a user with first and second internal speakers, the first internal speaker being part of a first earpiece positionable with respect to a first ear of the user, the first earpiece also including an internal microphone to capture speech from the first ear, and the second internal speaker being part of a second earpiece positionable with respect to a second ear of the user; and switching from the audio listening state to a communication state in which the speech from the user is captured and the second speaker is used to output sounds for the voice communication, wherein:

for the audio listening state, a circuit that interfaces the earpieces with an electronic device is configured to operatively couple the internal speakers respectively to first and second audio ports of the electronic device for outputting the stereo audio content to the internal speakers, and the internal microphone is switched to an off state; and for the communication state, the circuit is configured to switch the internal speaker of the first earpiece to an off state, switch the internal microphone of the first earpiece to an on state for the voice communication and operatively couple the internal microphone to a microphone port of the electronic device, and maintain the operative coupling of the internal speaker of the second earpiece to the respective audio port of the electronic device for use in the voice communication.

18. The method of claim 17, further comprising frequency equalizing the speech captured by the internal microphone.

19. The method of claim 17, further comprising detecting ambient sound with at least one external microphone and outputting a representation of the detected ambient sound with at least one of the internal speakers.

20. An earset assembly, comprising:

a first earpiece having an internal microphone to capture speech of a user and an internal speaker, the first earpiece positionable with respect to a first ear of the user so that the internal microphone detects the speech from the first ear of the user;

a second earpiece having an internal speaker, the second earpiece positionable with respect to a second ear of the user; and an electrical circuit operatively connecting the internal microphone and the internal speakers to a communication device, wherein:

in an audio listening state, the circuit is configured to operatively couple the internal speakers respectively to first and second audio ports of the communication device for outputting stereo audio content with the speakers, and the internal microphone is switched to an off state; and in a communication state, the circuit is configured to switch the internal speaker of the first earpiece to an off state, switch the internal microphone of the first earpiece to an on state for voice communication and operatively couple the internal microphone to a microphone port of the communication device, and maintain the operative coupling of the internal speaker of the second earpiece to the respective audio port for use in the voice communication, and wherein:

at least one of the first or second earpieces includes an external microphone to generate an audio signal representation of ambient sound, and the earset assembly further comprises an external sound control switch that switches between the output of the representation of ambient sound and the output of the stereo audio.

* * * * *